US012698934B2

(12) United States Patent
Yu et al.

(10) Patent No.: US 12,698,934 B2
(45) Date of Patent: Aug. 4, 2026

(54) HOME APPLIANCE

(71) Applicant: LG ELECTRONICS INC., Seoul (KR)

(72) Inventors: Geon Yu, Seoul (KR); Sanghyun Cheon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 196 days.

(21) Appl. No.: 18/834,949

(22) PCT Filed: Jan. 31, 2023

(86) PCT No.: PCT/KR2023/001370
§ 371 (c)(1),
(2) Date: Jul. 31, 2024

(87) PCT Pub. No.: WO2023/146379
PCT Pub. Date: Aug. 3, 2023

(65) Prior Publication Data

US 2025/0137717 A1 May 1, 2025

(30) Foreign Application Priority Data

Jan. 31, 2022 (KR) ..... 10-2022-0013835

(51) Int. Cl.
*F25D 27/00* (2006.01)
*F25D 23/02* (2006.01)
*F25D 29/00* (2006.01)

(52) U.S. Cl.
CPC ..... *F25D 27/00* (2013.01); *F25D 29/006* (2013.01); *F25D 23/028* (2013.01)

(58) Field of Classification Search
CPC ..... F21D 27/00; F21D 23/028; F25D 29/006
USPC ..... 362/92
See application file for complete search history.

(56) References Cited

U.S. PATENT DOCUMENTS

| | | | | |
|---|---|---|---|---|
| 8,789,900 | B2 | 7/2014 | Laible et al. | |
| 2005/0056046 | A1* | 3/2005 | Lee | F25D 29/006 62/440 |
| 2018/0310726 | A1* | 11/2018 | Oh | A47F 3/0434 |
| 2019/0316830 | A1* | 10/2019 | Kim | F25D 23/028 |
| 2021/0325107 | A1* | 10/2021 | Kang | F25D 23/028 |

FOREIGN PATENT DOCUMENTS

| | | | |
|---|---|---|---|
| CN | 202660850 | U | 1/2013 |
| EP | 3 896 373 | A1 | 10/2021 |
| JP | 2017-133801 | A | 8/2017 |
| KR | 20-1999-0027937 | U | 7/1999 |
| KR | 10-2013-0072186 | A | 7/2013 |
| KR | 10-2018-0120005 | A | 11/2018 |

* cited by examiner

*Primary Examiner* — Thomas M Sember
(74) *Attorney, Agent, or Firm* — Birch, Stewart, Kolasch & Birch, LLP

(57) ABSTRACT

The present invention relates to a home appliance comprising: a cabinet having a storage space; and a door configured by a door body for opening or closing the cabinet and a panel assembly detachably mounted to the door body, wherein the panel assembly includes: a panel forming the front surface of the door; and a lighting device provided behind the panel, and the door body is provided with a grounding member for inducing static electricity generated in the panel assembly to the door body.

20 Claims, 20 Drawing Sheets

[Fig. 1]
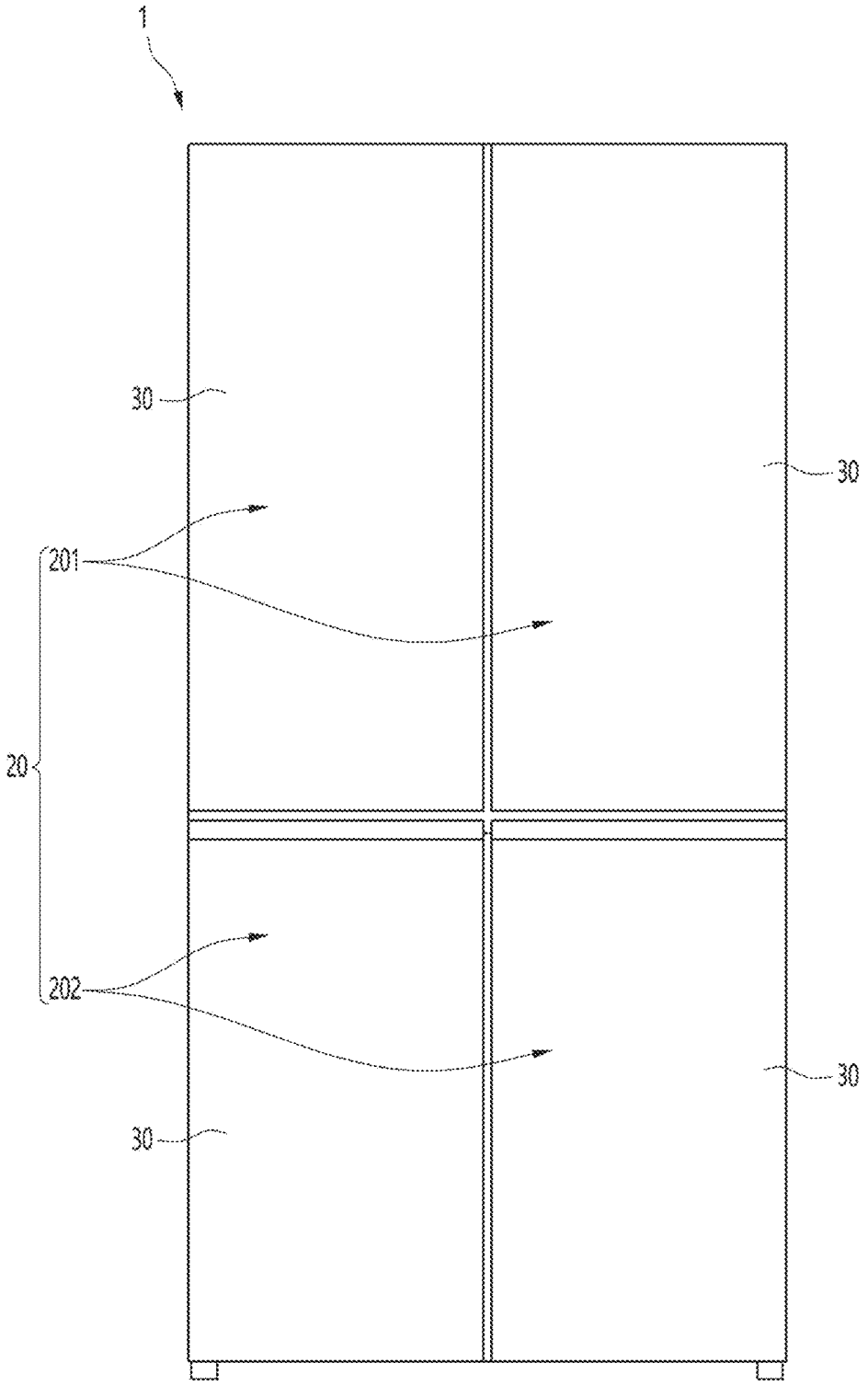

[Fig. 2]
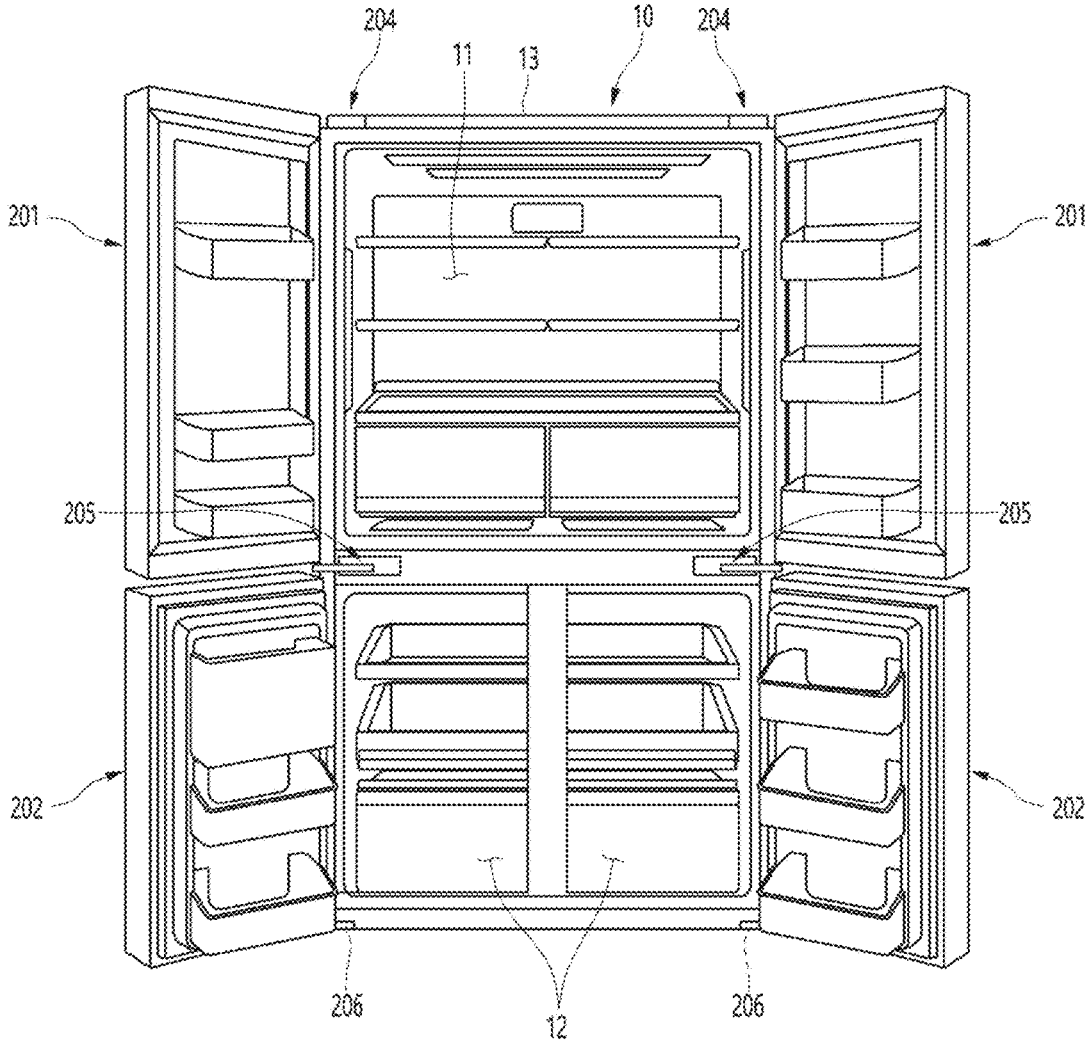

[Fig. 3]
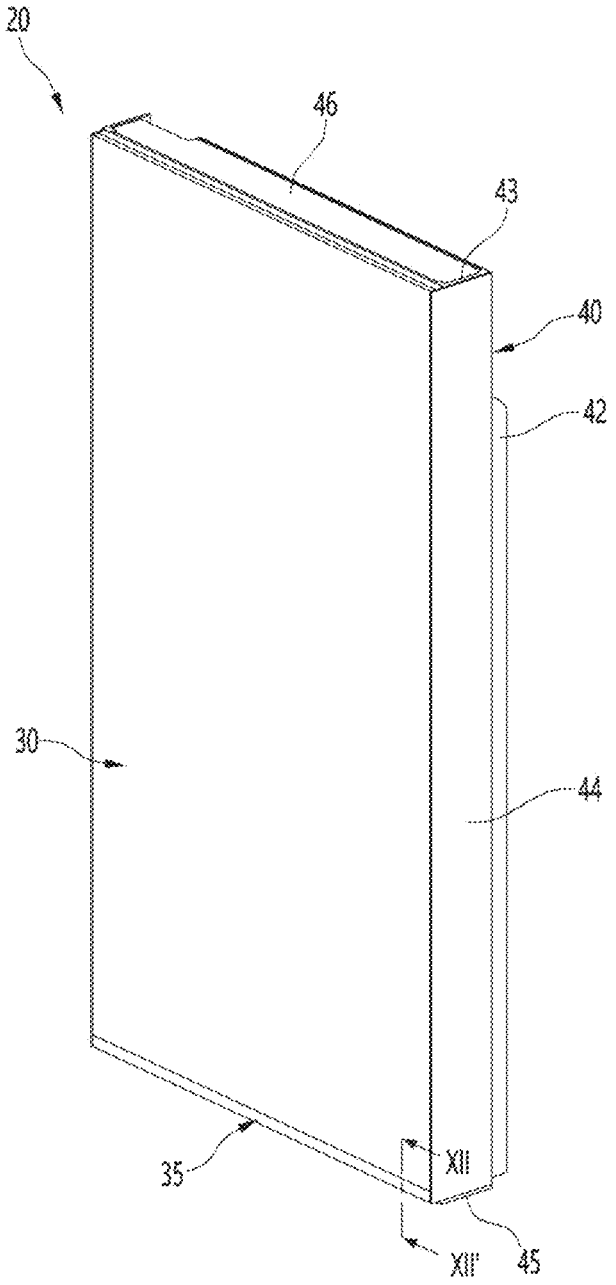

[Fig. 4]
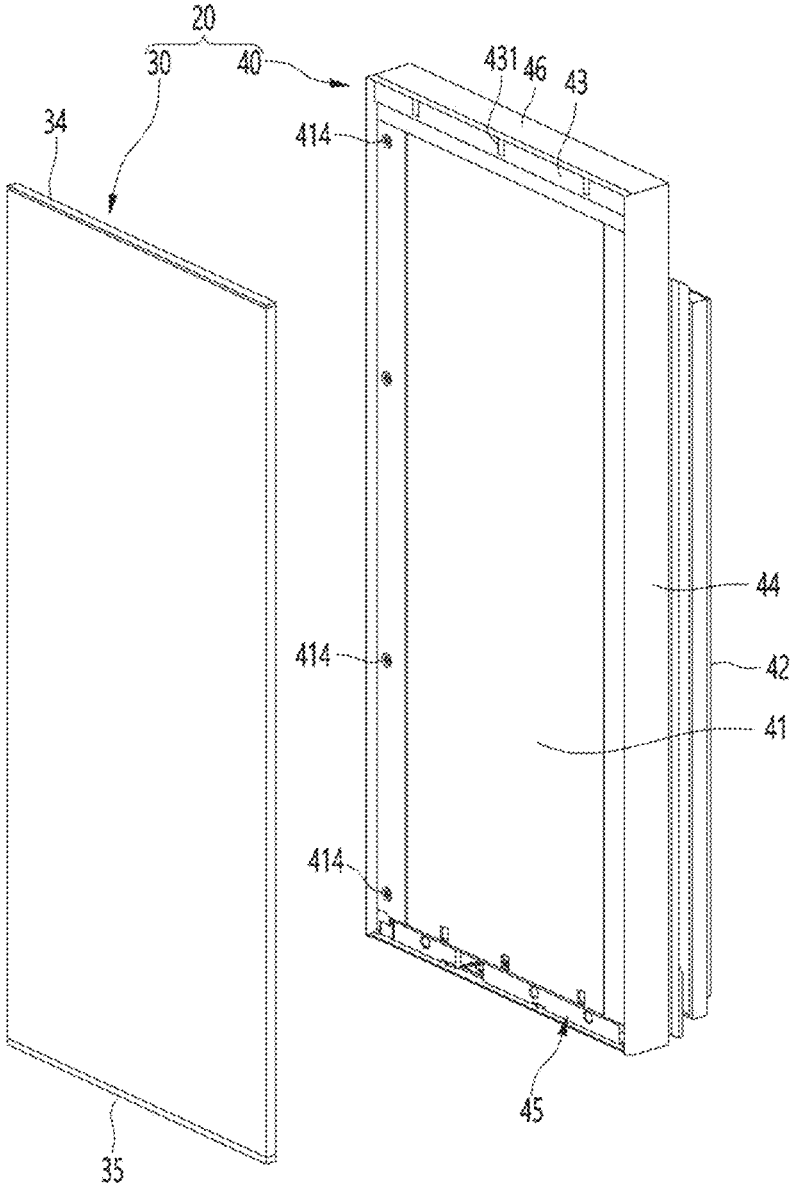

[Fig. 5]
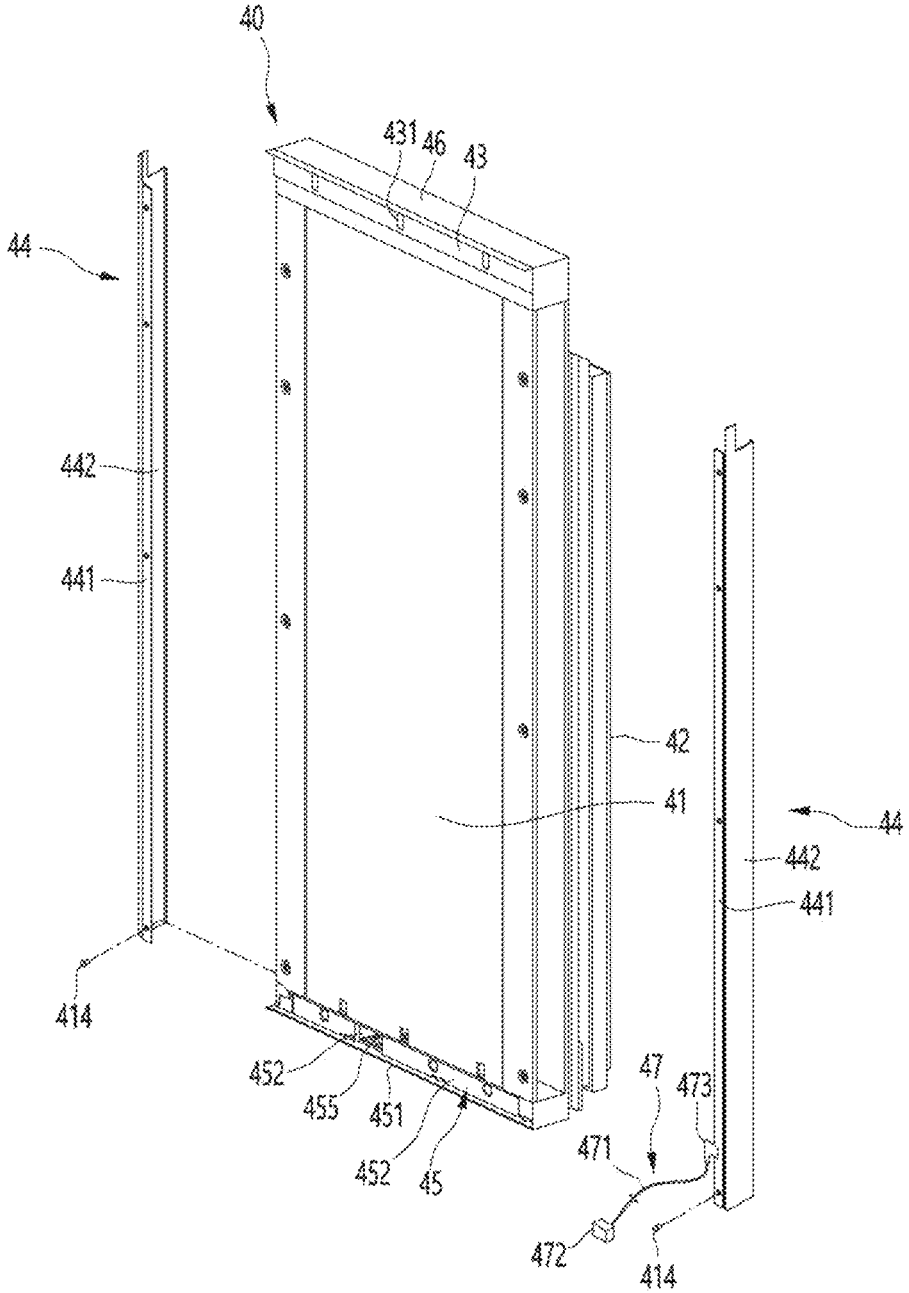

[Fig. 6]
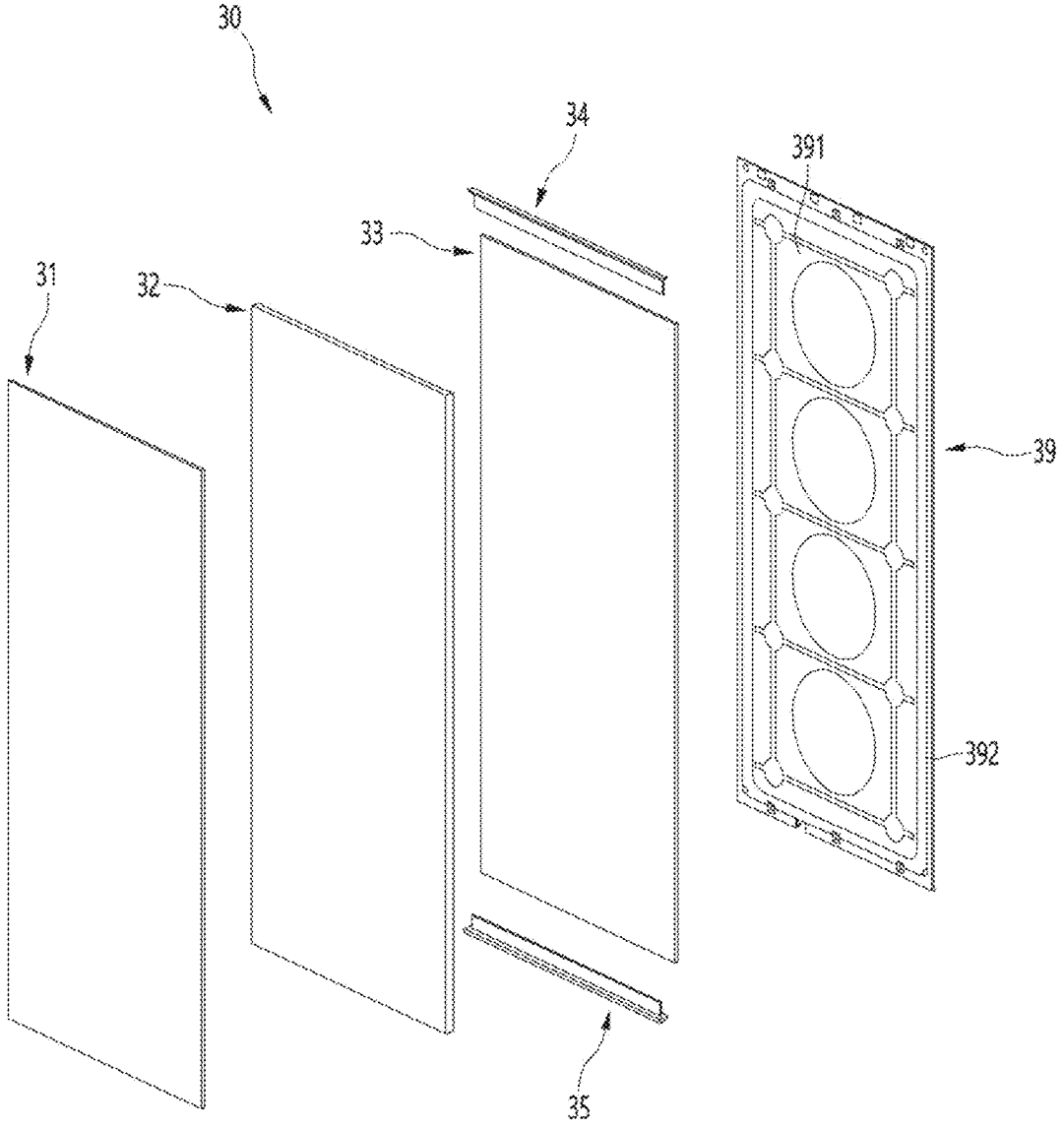

[Fig. 7]
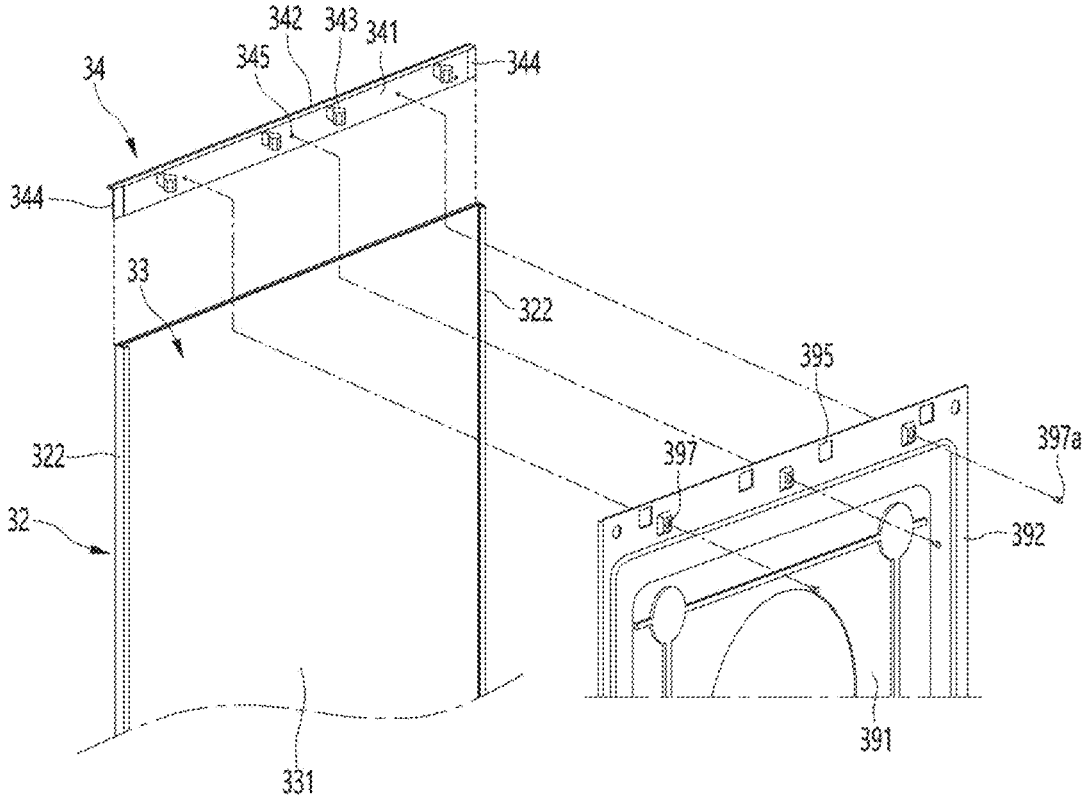

[Fig. 8]
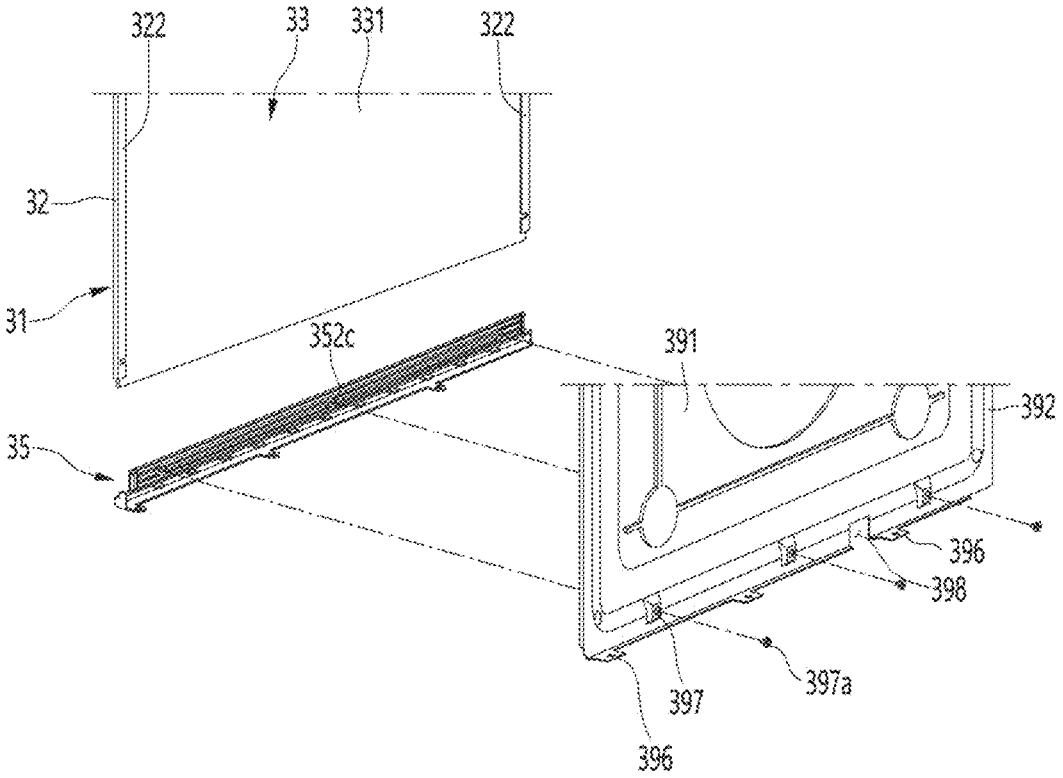

[Fig. 9]
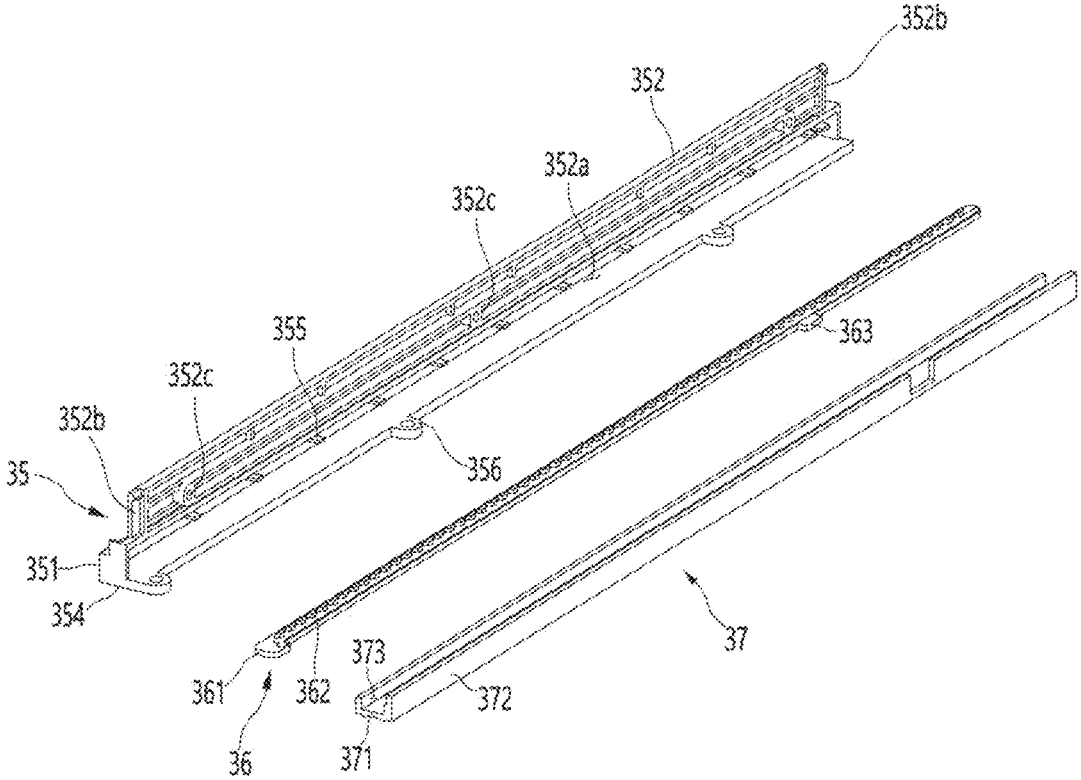

[Fig. 10]
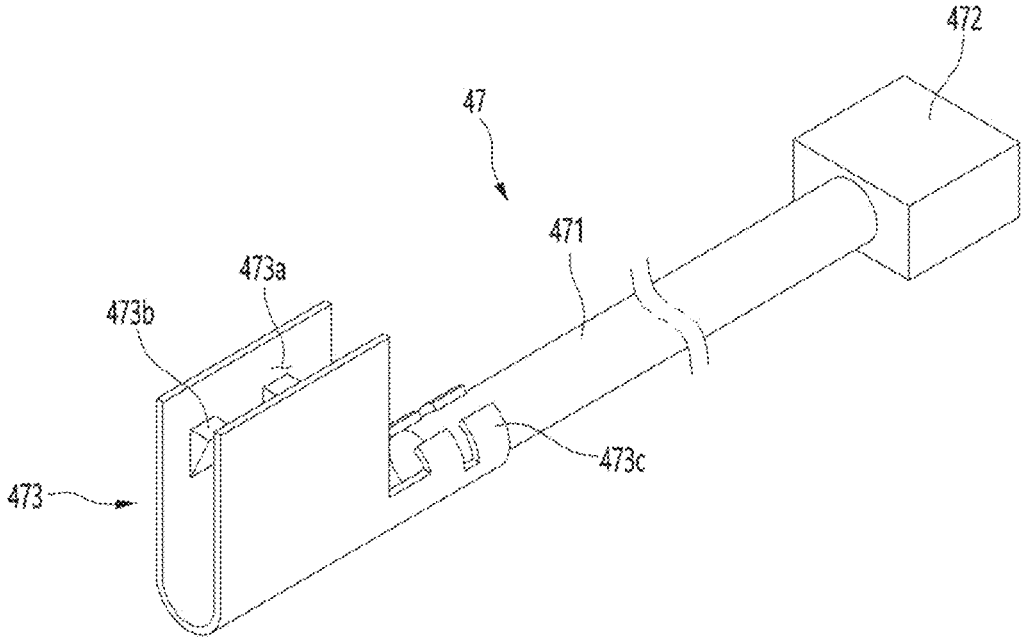

[Fig. 11]
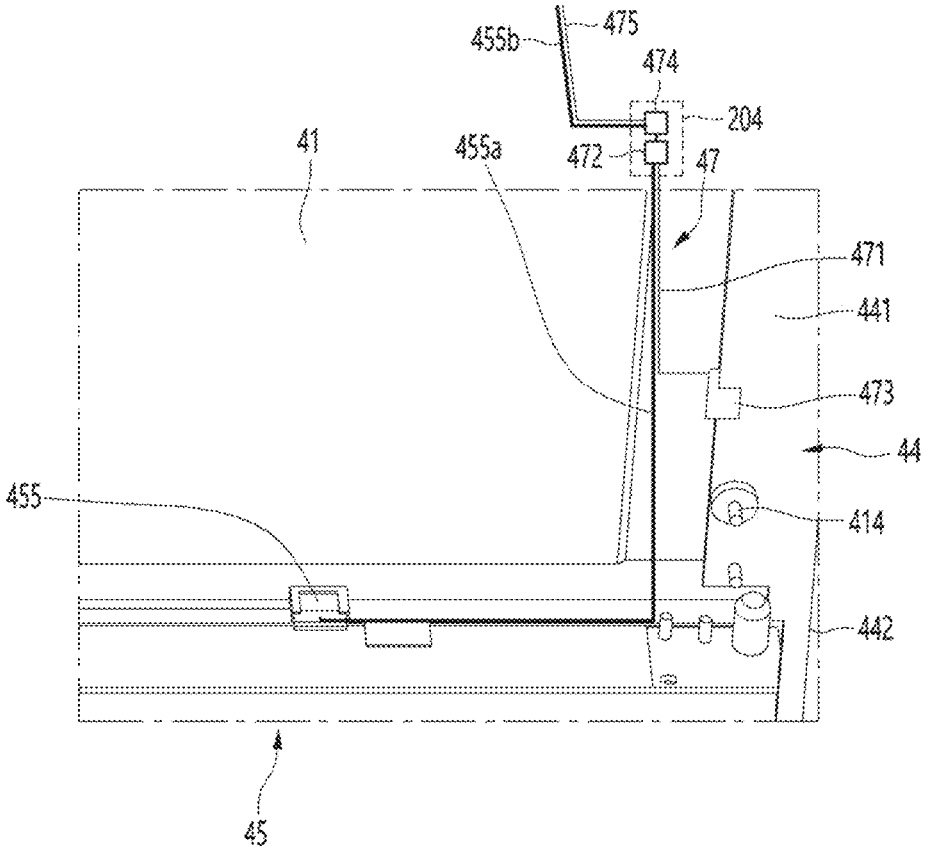

[Fig. 12]
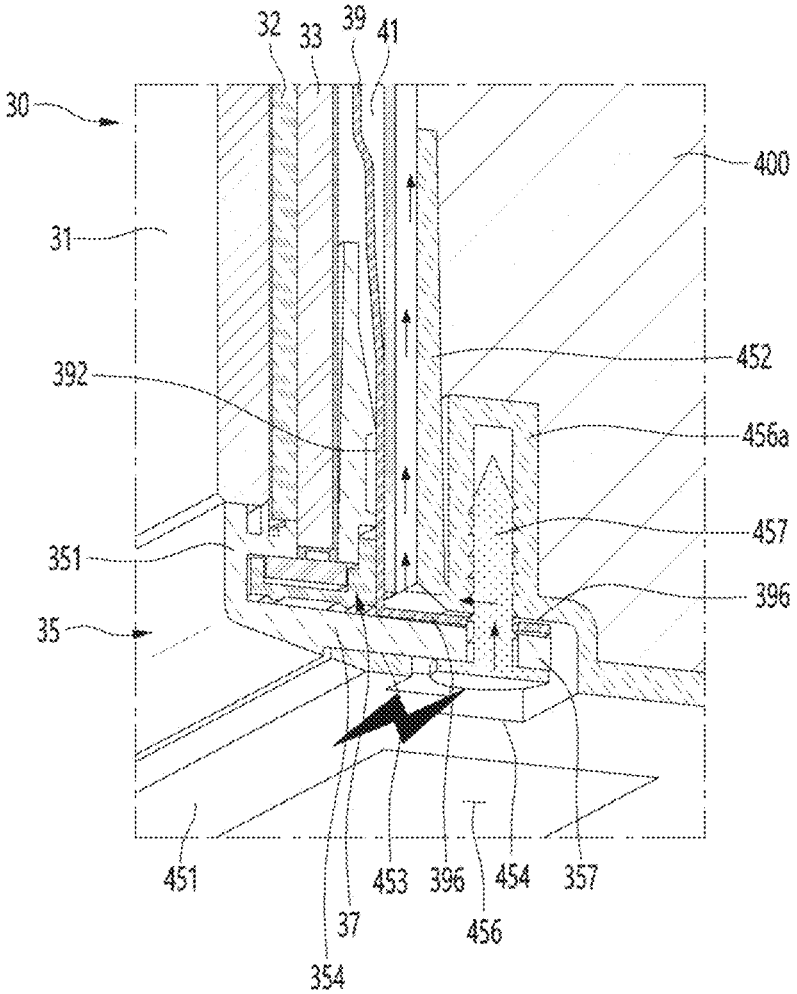

[Fig. 13]
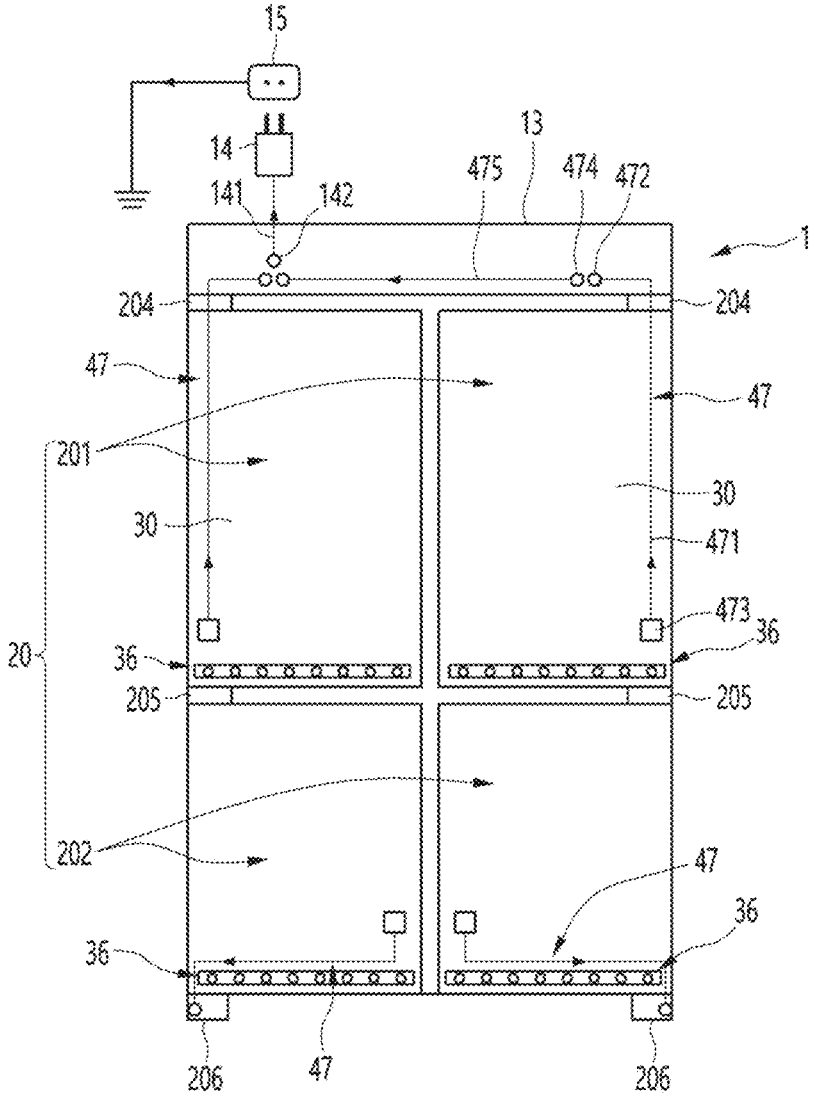

[Fig. 14]
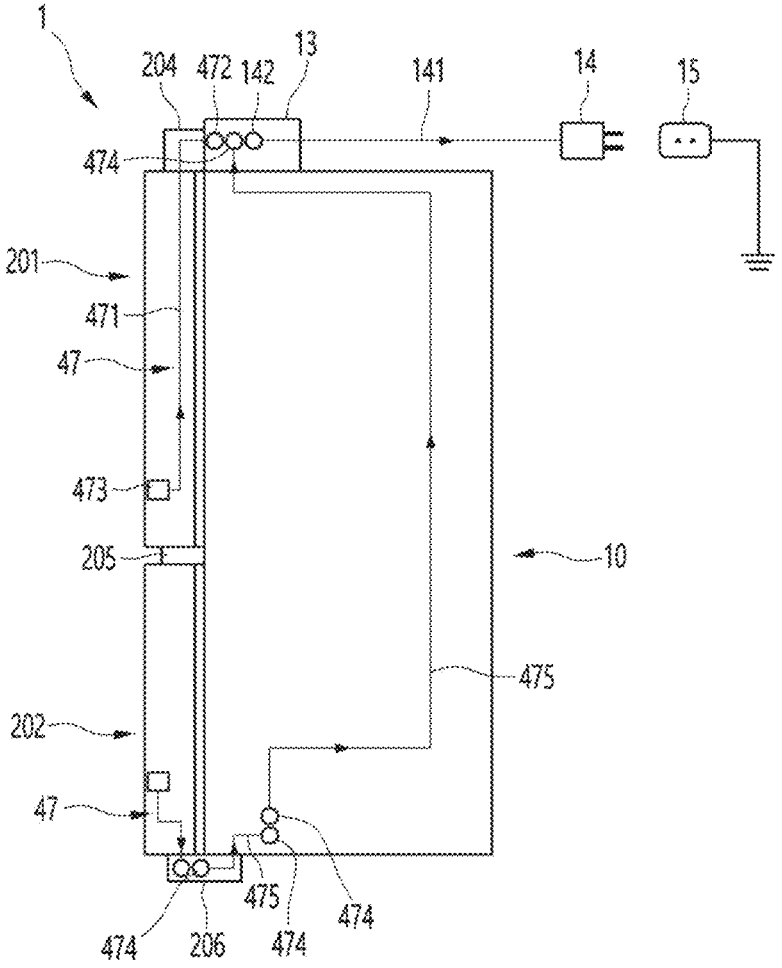

[Fig. 15]
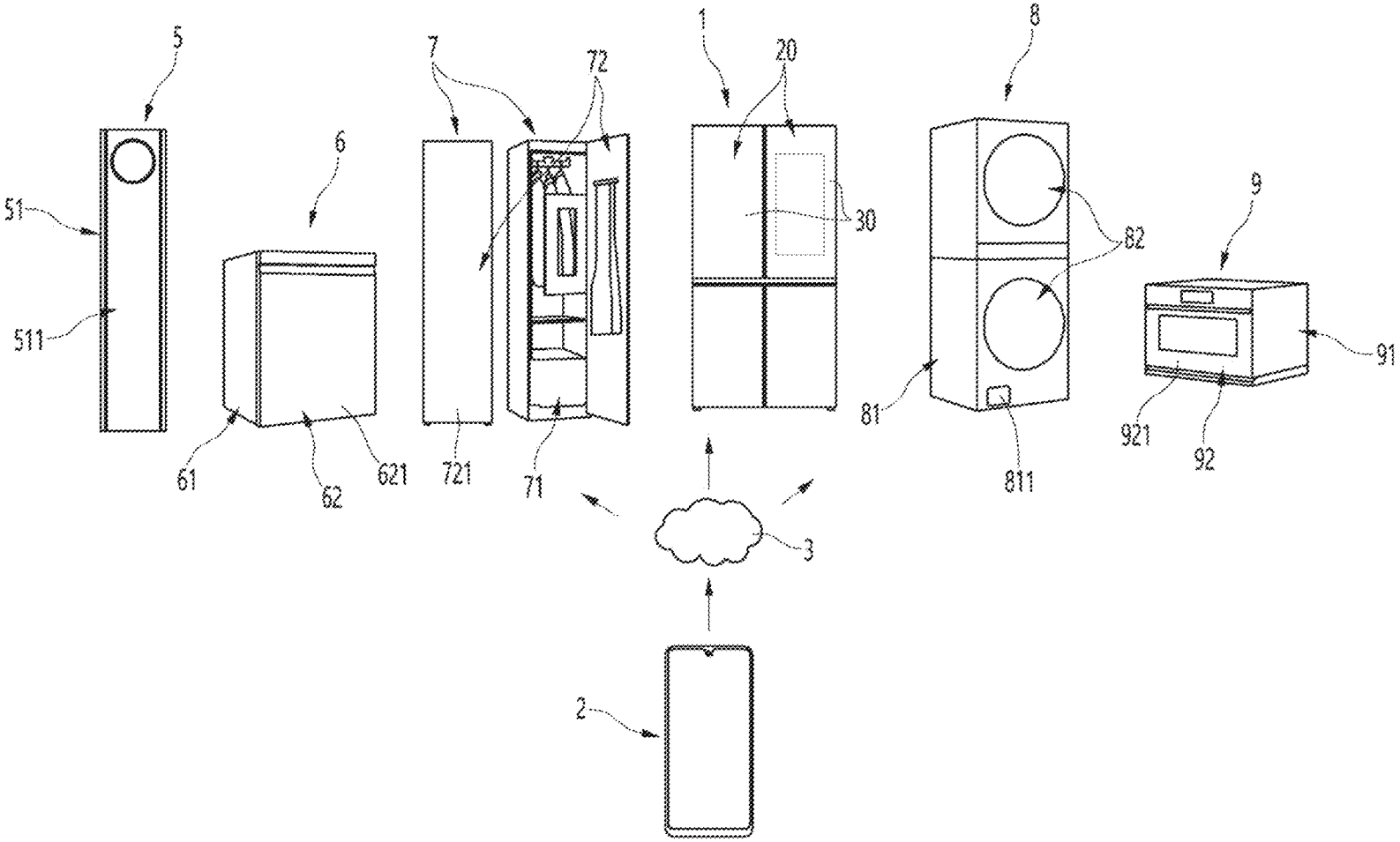

[Fig. 16]
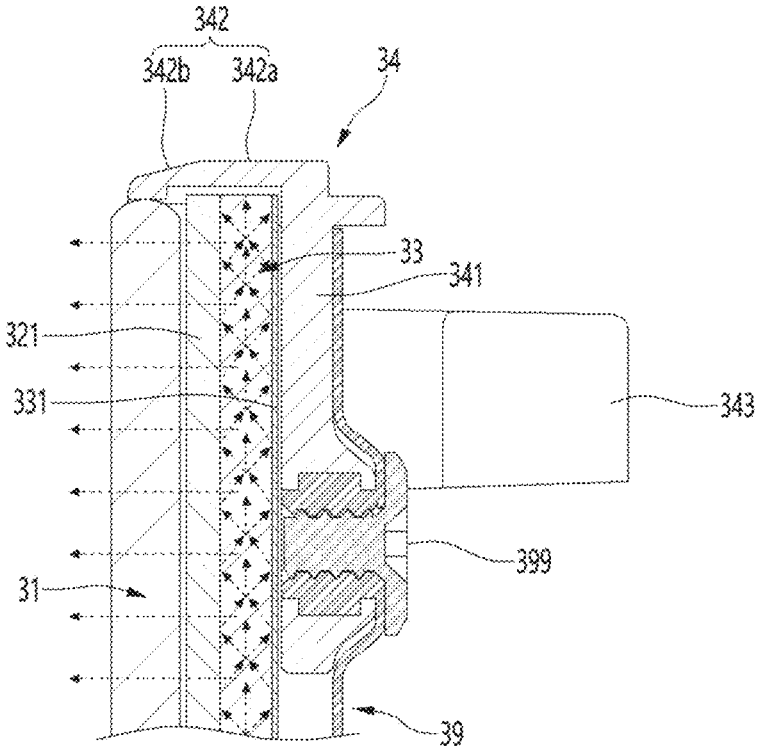
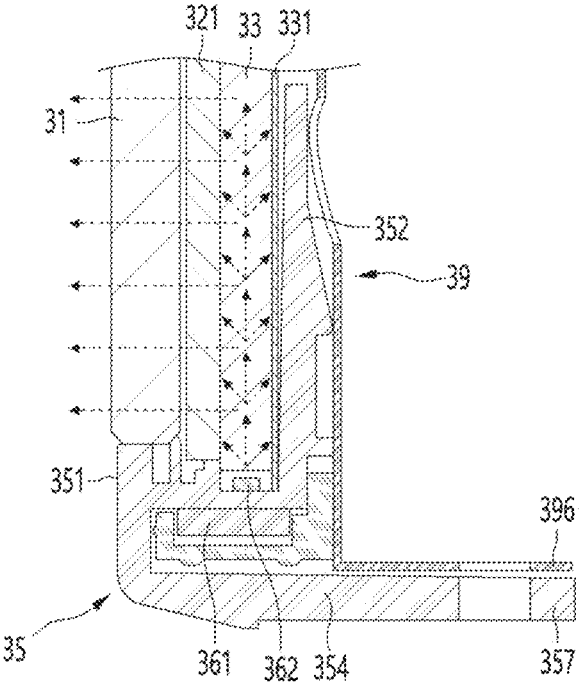

[Fig. 17]
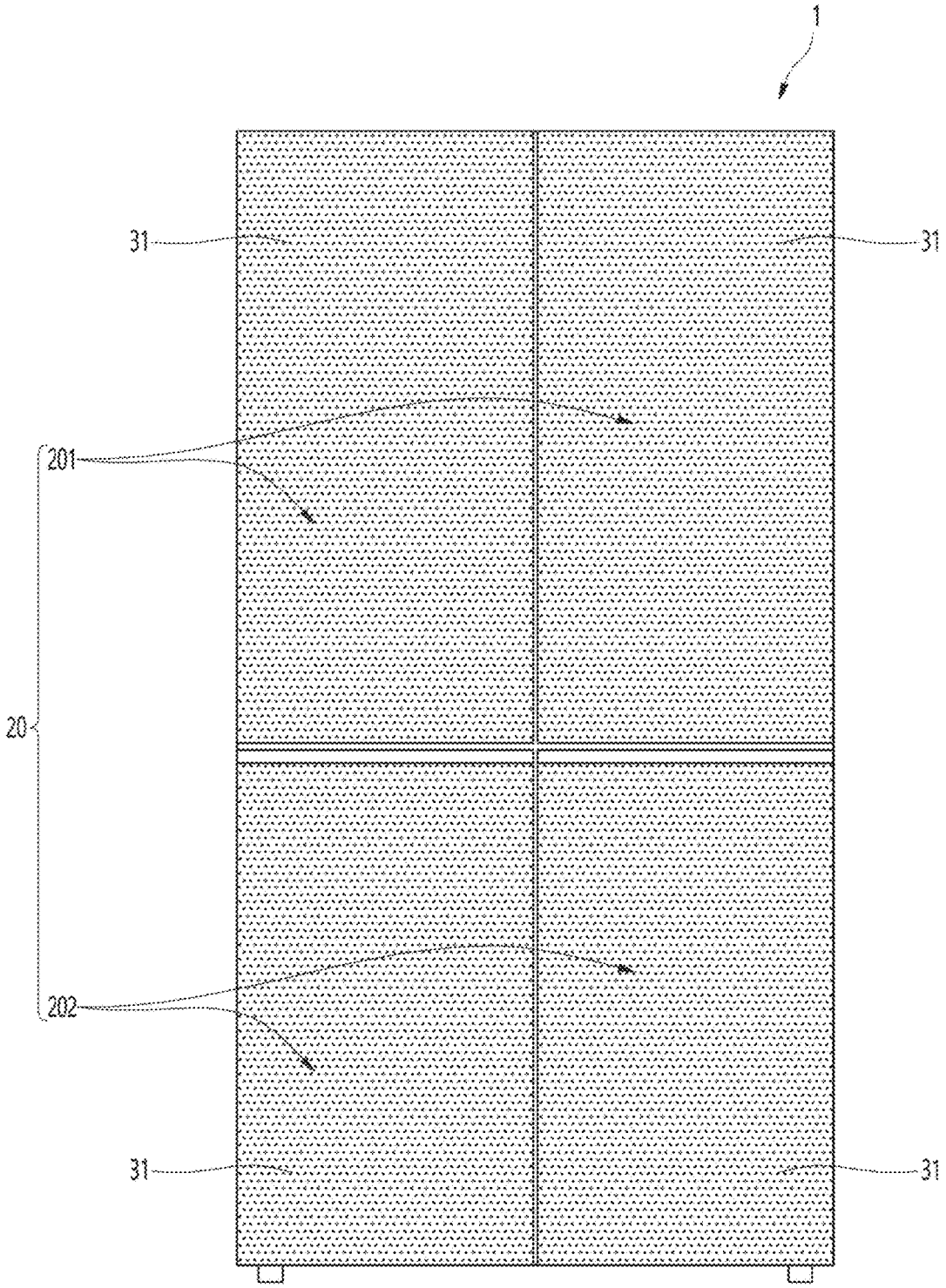

[Fig. 18]
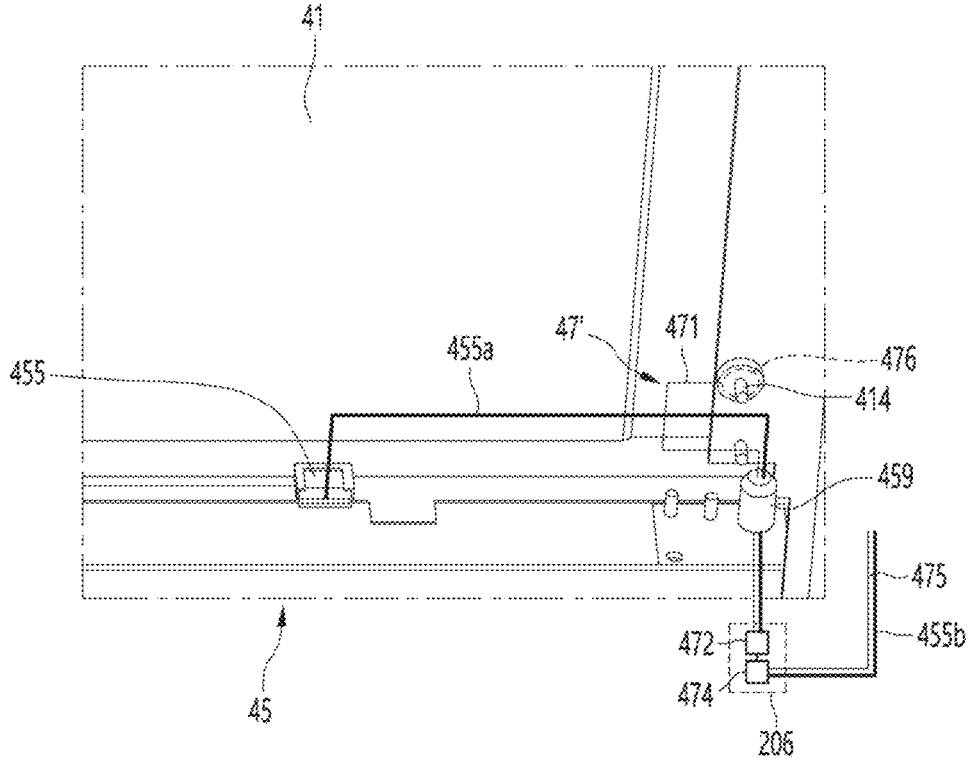

[Fig. 19]
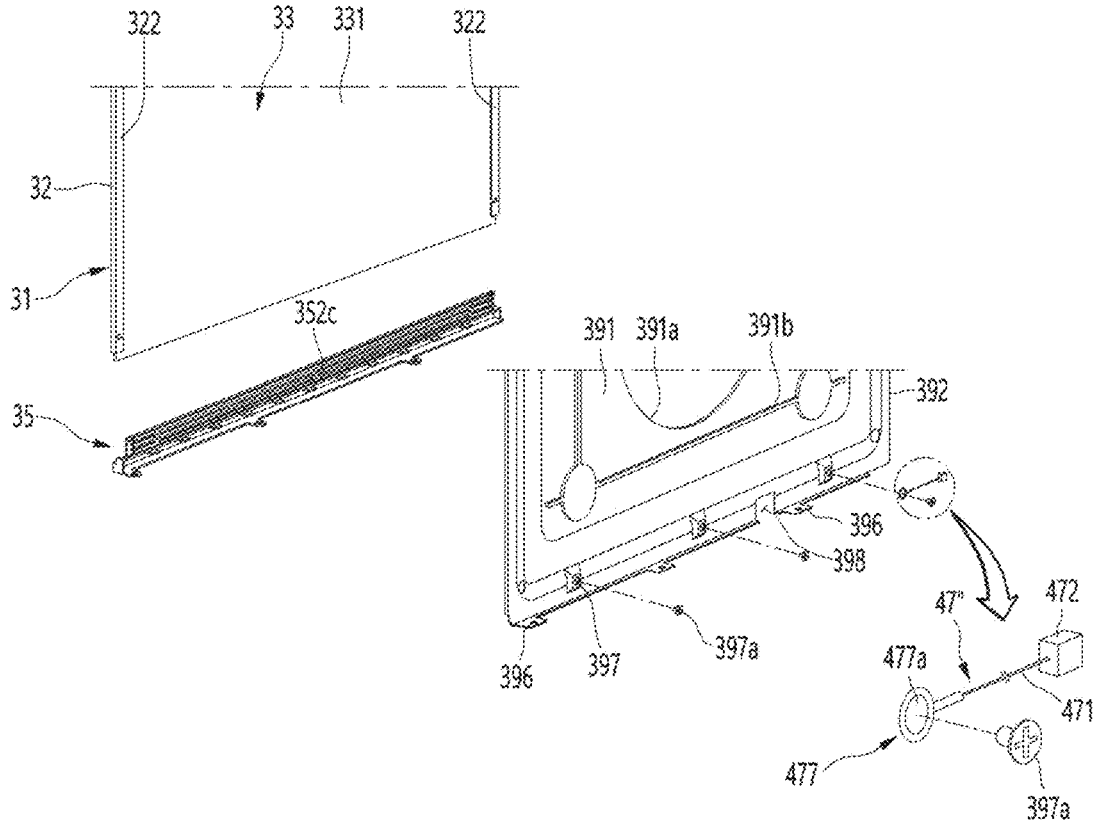

[Fig. 20]
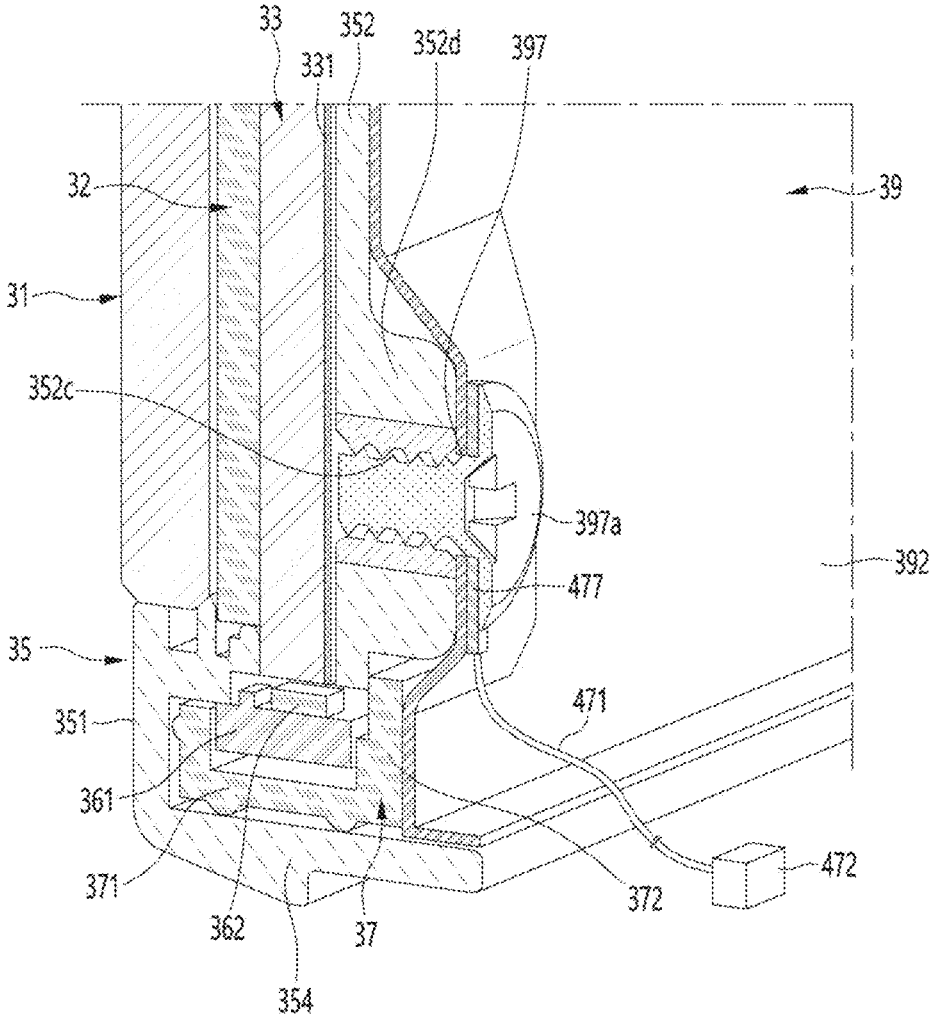

HOME APPLIANCE

CROSS REFERENCE TO RELATED APPLICATIONS

This application is the National Phase of PCT International Application No. PCT/KR2023/001370, filed on Jan. 31, 2023, which claims priority under 35 U.S.C. 119 (a) to Patent Application No. 10-2022-0013835, filed in the Republic of Korea on Jan. 31, 2022, all of which are hereby expressly incorporated by reference into the present application.

TECHNICAL FIELD

The present disclosure relates to a home appliance.

BACKGROUND ART

Generally, home appliances are disposed in an indoor space and be disposed to harmonize with a surrounding space. In addition, to further improve an outer appearance of such a home appliance, a panel that defines the outer appearance may be provided on a front surface of the home appliance.

Representatively, structures for refrigerators having various outer appearances of the front surface to harmonize with environments, in which the refrigerators are disposed, surrounding furniture, or other home appliances, and this trend is taking place across home appliances.

A structure in which a deco panel that defines an outer appearance is disposed on a front surface of a door of a refrigerator is disclosed in U.S. Pat. No. 8,789,900, and the deco panel is detachably configured to define the outer appearance of the door, which suits user's preference.

However, in the refrigerator having the above-described structure, if a user requires to change in outer appearance, there is a problem in that the entire deco panel has to be removed and replaced, and the deco panel is not used any longer.

To solve this problem, a refrigerator, in which a reflective layer and a transparent panel are provided on a front surface of a door of a refrigerator, and a light emitting having a color is mounted on each of both ends of the reflective layer so that the transparent panel shines in a set color, is disclosed in Chinese Patent No. 103250018.

However, in this structure, when the user manipulates the door to open or close the door, there is a problem in that static electricity is transferred to the light emitting member inside the door to damage the light emitting member.

In addition, when the light emitting member is damaged, there is a serious problem in that defects of the outer appearance of the door occur, and the entire door has to be separated to replace the light emitting member.

DISCLOSURE OF THE INVENTION

Technical Problem

An object of an embodiment of the present invention is to provide a home appliance in which a lighting device is prevented from being damaged by static electricity to maintain quality of an outer appearance.

An object of an embodiment of the present invention is to provide a home appliance in which a lighting device having a heat dissipation structure is prevented from being damaged by static electricity.

An object of an embodiment of the present invention is to provide a home appliance in which a grounding member is provided on a panel assembly that is detachable from a door.

Technical Solution

A home appliance according to an embodiment of the present invention includes: a cabinet having a storage space; and a door constituted by a door body that opens or closes the cabinet and a panel assembly detachably mounted on the door body, wherein the panel assembly includes: a panel defining a front surface of the door; and a lighting device provided behind the panel, wherein the door body is provided with a grounding member configured to static electricity generated in the panel assembly to the door body.

The door body may include: a body plate facing the panel assembly; and a side deco defining a side surface of the door body, wherein at least one of the body plate or the side deco may be made of a metal material, and the grounding member may be connected to the body plate or the side deco.

The grounding member may include a fixing part which is made of a conductive material and into which an end of the body plate or the side deco is inserted.

The grounding member may include a fixing part made of a conductive material and inserted between the body plate and the side deco, which are in contact with each other.

The grounding member may include a fixing part which is made of a conductive material and through which a coupling member configured to connect the body plate to the side deco passes.

The panel assembly may include a back cover defining a rear surface of the panel assembly and made of a metal material, and at least one of the body plate or the side deco may be in contact with the back cover.

The panel assembly may include a back cover defining a rear surface of the panel assembly and made of a metal material, and the grounding member may include a fixing part made of a conductive material and connected to the back cover.

A cover coupling member configured to couple the back cover may be coupled to the back cover, and the fixing part may be penetrated by the cover coupling member.

The grounding member may include: a ground wire extending along the inside of the door body; a fixing part provided on one end of the ground wire and made of a conductive material to be electrically connected to the panel assembly; and a ground connector provided at the other end of the ground wire and connected to a cabinet ground wire disposed on the cabinet.

The grounding member may include: a ground wire guided toward the cabinet by passing through a hinge device configured to connect the door to the cabinet inside the door body; and a ground connector provided on an end of the ground wire, wherein the ground connector may be connected to a cabinet connector of a cabinet ground wire provided on the cabinet.

The home appliance may further include a power cord connected to an inlet of a wall to supply power, wherein the power cord may include: a power ground wire for grounding; and a power connector provided on one end of the power ground wire and connected to the ground connector or the cabinet connector.

The door may be provided in plurality, and the ground connector of the ground wire, the cabinet connector, and the power connector, which extend from the plurality of doors, may be connected to a control box provided on a top surface of the cabinet.

The door body may be provided with a lighting connector connected to a substrate connection part provided in the lighting device, and a wire connected to the lighting connector may be guided to the outside of the door together with a ground wire of the grounding member.

Ends of the wire and the ground wire may be connected to one ground connector, ends of a cabinet wire and a cabinet ground wire, which are provided on the cabinet, may be connected to one cabinet connector, and the wire, the cabinet wire, the ground wire, and the cabinet ground wire may be connected to each other by connecting the ground connector to the cabinet connector.

A handle configured to open and close the door may be provided on the door body, and the grounding member may be provided at a side adjacent to the handle with respect to a center of the door.

Advantageous Effects

The home appliance according to the proposed embodiment may expect the following effects.

According to the embodiment of the present invention, even if the static electricity is generated when the user is in contact with the door to open the door while using the home appliance, the static electricity may be induced through the grounding member and thus be prevented from being introduced into the lighting device of the panel assembly. Therefore, there may be the effect of preventing the lighting device from being damaged by the static electricity.

Particularly, there may have the advantage in preventing the outer appearance defects from occurring on the front surface of the home appliance due to the damage of the lighting device, and solving the inconvenience in separation and service work of the panel assembly due to the damage of the lighting device.

In addition, there may be advantageous in that the static electricity is effectively induced toward the door body through the grounding member without being induced toward the lighting device even in the structure in which the lighting device is disposed adjacent to the handle for manipulating the door because the grounding member is made of the material having the electrical resistance less than that of the back cover.

In addition, there may be advantageous in that the grounding member has the structure that is inserted into and mounted on the body plate or the side deco of the door body so that the additional structure for fixing the grounding member is not required, and the grounding member is easily disposed.

In addition, there may be advantageous in that the grounding member is fixed by the coupling member for assembling the door body so that the grounding member is mounted during the process of assembling the door body without the additional arrangement structure or process for arranging the grounding member to thereby improve workability.

In addition, there may be advantageous in that the one side of the door body provided with the grounding member is electrically connected to the back cover of the panel assembly so that the grounding member is disposed independently of the panel assembly to implement the grounding structure regardless of the detachable structure of the panel assembly.

In addition, there may be advantageous in that the grounding member is fixed to the back cover by the cover coupling member coupled to couple the back cover so that the grounding member is grounded during the process of assembling the door body without the additional arrangement structure or process for disposing the grounding member.

In addition, the wire connected to the light connector connected to the lighting device and the ground wire of the grounding member may be disposed in the same path to further facilitate the arrangement of the ground wire and the wire.

In addition, there may be advantageous in that the static electricity is induced toward the grounding member without being introduced into the lighting device through the back cover and the light supporter even in the structure in which the light supporter, which supports the lighting device, and the back cover are in contact with each other to block the heat generated in the lighting device, thereby maximizing the heat dissipation effect and preventing the lighting device from being damaged.

BRIEF DESCRIPTION OF THE DRAWINGS

FIG. 1 is a front view according to an embodiment of the present invention.

FIG. 2 is a front view of a refrigerator with a door opened.

FIG. 3 is a perspective view of the door.

FIG. 4 is an exploded perspective view illustrating a state in which a panel assembly and a door body, which constitute the door, are separated from each other.

FIG. 5 is an exploded perspective view illustrating a state in which a side deco of the door body is separated.

FIG. 6 is an exploded perspective view when the panel assembly is viewed from a front side.

FIG. 7 is an exploded perspective view illustrating a coupled structure of a fixing member, which is one component of the panel assembly, an upper bracket, and a back cover.

FIG. 8 is an exploded perspective view illustrating a coupled structure in which the fixing member, which is one component of the panel assembly, a lower bracket, and the back cover.

FIG. 9 is an exploded perspective view illustrating a coupling structure of the lower bracket, a lighting device, and a light supporter.

FIG. 10 is a perspective view of a grounding member according to an embodiment of the present invention.

FIG. 11 is a partial perspective view illustrating a configuration of a door body on which the grounding member is mounted.

FIG. 12 is a view illustrating an inflow and transfer path of static electricity to the door.

FIG. 13 is a schematic front view illustrating an arrangement of a ground wire in the refrigerator.

FIG. 14 is a schematic side view illustrating the arrangement of a ground wire in the refrigerator.

FIG. 15 is a view illustrating an example of adjusting colors of home appliances to which the panel assembly using a remote device is applied.

FIG. 16 is a cross-sectional view illustrating a light emitting state of the panel assembly.

FIG. 17 is a front view illustrating an outer appearance of a front surface of the refrigerator in which the lighting device is turned on.

FIG. 18 is a partial perspective view illustrating a configuration of a door body to which a grounding member is mounted according to another embodiment of the present invention.

FIG. 19 is an exploded perspective view of a panel assembly according to further another embodiment of the present invention.

FIG. 20 is a cutaway perspective view illustrating a state in which the grounding member is mounted on the panel assembly.

MODE FOR CARRYING OUT THE INVENTION

Hereinafter, detailed embodiments will be described in detail with reference to the accompanying drawings. However, the scope of the present disclosure is not limited to proposed embodiments of the present invention, and other regressive inventions or other embodiments included in the scope of the spirits of the present disclosure may be easily proposed through addition, change, deletion, and the like of other elements.

Before explaining, directions will be defined. In an embodiment of the present invention, a direction that is directed to a door may be defined as a front direction based on a cabinet illustrated in FIG. 2, a direction that is directed to the cabinet may be defined as a rear direction based on the door, a direction that is directed to a bottom surface on which the refrigerator is installed may be defined as a downward direction, and a direction that is away from the bottom surface may be defined as an upward direction.

FIG. 1 is a front view according to an embodiment of the present invention. In addition, FIG. 2 is a front view of a refrigerator with a door opened.

As illustrated in the drawings, an outer appearance of a refrigerator 1 according to an embodiment of the present invention may be defined by a cabinet 10 defining a storage space and a door 20 opening and closing the storage space of the cabinet 10.

For example, the cabinet 10 may define a storage space that is divided into upper and lower spaces. Here, a refrigerating compartment 11 may be defined in the upper spaced, and a freezing compartment 12 may be defined in the lower space. The refrigerating compartment 11 may be referred to as an upper storage space, and the freezing compartment 12 may be referred to as a lower storage space.

The cabinet 10 may be provided with a control box 13. The control box 13 may be provided with a controller that controls an operation of the refrigerator 1. In addition, a power cord 141 (see reference symbol 141 in FIG. 14) that provides power for the operation of the refrigerator 1 may be connected to the control box 13. The control box 13 may be provided on a top surface of the cabinet 10 and may be configured to connect a pair of hinge devices 204 disposed on both sides of the cabinet 10. Thus, the control box 13 may have a structure that facilitates a connection and arrangement of the ground wire (see reference numeral 471 in FIG. 11) and a cabinet ground wire (see reference numeral 475 in FIG. 11), which will be described below.

The door 20 may be configured to open and close each of the refrigerating compartment 11 and the freezing compartment 12. The door 20 may include a refrigerating compartment door 201 that opens and closes the refrigerating compartment 11 and a freezing compartment door 202 that opens and closes the freezing compartment 12. In addition, a pair of the refrigerating compartment doors 201 may be disposed side by side at both left and right sides, and each of the refrigerating compartment doors 201 may partially open and close the refrigerating compartment 11. In addition, a pair of the freezing compartment doors 202 may be disposed side by side at both left and right sides, and the freezing compartment 12 divided into the left and right sides may be opened and closed, respectively. Since the refrigerating compartment door 201 is provided at an upper portion of the cabinet 10, the refrigerating compartment door 210 may be referred to as an upper door, and since the freezing compartment door 202 is provided at a lower portion of the cabinet 10, the freezing compartment door 202 may be referred to as a lower door.

The door 20 may be connected by hinge devices 204, 205, and 206 and be rotatably mounted on the cabinet 10. The door may rotate to open and close each of the refrigerating compartment 11 and the freezing compartment 12.

In detail, the hinge devices 204, 205, and 206 may include at least one or more of an upper hinge 204, a lower hinge 026, and an intermediate hinge 205. The upper hinge 204 may be provided at an upper end of the cabinet 10 and may rotatably support an upper end of the door 20 (201). In addition, the lower hinge 206 may be provided at a lower end of the cabinet 10 and may rotatably support a lower end of the door 20 (202). In addition, when the doors 201 and 202 are disposed vertically, the intermediate hinge 205 may be disposed between the doors 201 and 202 to support the lower end of the door 201 and a lower end of the lower door 202.

In addition, a wire 455*a* connected to an electrical component such as a lighting device 36 inside the door 20 and a ground wire 471 for grounding may pass through the hinge devices 204, 205, and 206 and then be guided into the cabinet 10.

In the present embodiment, for convenience of explanation and understanding, the refrigerator having a structure in which the refrigerating compartment 11 is disposed at an upper side, and the freezing compartment 12 is disposed at a lower side is described as an example, but the present invention is not limited the shape of the refrigerator, and may be applied to all types of the refrigerator provided with the doors.

The door 20 may define an outer appearance of the front surface of the refrigerator 1 in a closed state and may define the outer appearance of the refrigerator 1, which is seen from the front side when the refrigerator 1 is installed.

The door 20 may have a structure that allows the front surface to selectively emit light and may be configured to illuminate with a set color or brightness. Thus, the user may manipulate the color or brightness of the front surface of the door 20 to be changed without separating or disassembling the door 20 and change an overall outer appearance of the refrigerator 1.

Hereinafter, the structure of the door 20 will be described in detail with reference to the drawings. In addition, an embodiment of the present invention will be described based on the refrigerating compartment door 201, and other doors may also have the same structure with only a difference in a mounted position.

FIG. 3 is a perspective view of the door. In addition, FIG. 4 is an exploded perspective view illustrating a state in which a panel assembly and a door body, which constitute the door, are separated from each other. In addition, FIG. 5 is an exploded perspective view illustrating a state in which a side deco of the door body is separated.

As illustrated in the drawings, the door 20 may include a door body 40 that defines the overall shape of the door 20 to open and close the storage space, and a panel assembly 30 that defines the outer appearance of the front surface of the door 20.

The door body 40 may include a body plate 41 that defines the front surface and a door liner 42 that defines a rear surface. The body plate 41 may be made of a metal material and may be disposed to face the rear surface of the panel assembly 30. In addition, the door liner 42 may be made of a plastic material and may define a shape of the rear surface of the door 20.

The door body 40 may include a side deco 44 that define each of both left and right sides of the door body 21. The side deco 44 may extend in a vertical direction, and thus, an upper end of the side deco 44 may be coupled to an upper cap deco 43, and a lower end of the side deco 44 may be coupled to a lower cap deco 45.

The side deco 44 may include a deco front surface 441 and a deco side surface 442.

The deco front surface 441 may define a front surface of the side deco 44 and may support the body plate 41 from a rear side. The front of the deco 441 and both left and right ends of the body plate 41 may overlap each other and may be coupled to each other by a coupling member 414 such as a rivet or screw. In addition, the deco front surface 441 may connect the upper cap deco 43 to the lower cap deco 45.

The deco side surface 442 may be defined perpendicular to the deco front surface 441 to define the side surface of the door body 40. The deco front surface 441 may extend vertically from an inner surface of the deco side surface 442, and an outer surface of the deco side surface 442 may be provided in a planar shape.

In addition, the front end of the deco side surface 442 may be provided to further protrude than the deco front surface 441. Thus, when the panel assembly 30 is mounted on the door body 40, the front end of the protruding deco side surface 442 may support at least a portion of a side end of the panel assembly 30.

The deco side surface 442 may be provided in a size corresponding to a front-to-rear width of each of the upper cap deco 43 and the lower cap deco 45. In addition, the deco side surface 442 may extend from the side end of the upper cap deco 43 to the side end of the lower cap deco 45.

The side deco 44 may be made of a metal material, for example, an aluminum material. In addition, the side deco 44 may be provided by integrally molding the deco front surface 441 and the deco side surface 442 and may be provided by bending a metal plate-shaped material several times.

In addition, the side deco 44 may be provided with a grounding member 47, which will be described below, and thus, when the static electricity is introduced into the door 20, the static electricity may not be directed to the panel assembly 30, but be directed toward the cabinet 10 through the door body 40.

The door body 40 may include an upper cap deco 43 and a lower cap deco 45, which define top and bottom surfaces of the door body 40. The upper cap deco 43 may be connected to an upper end of the side deco 44, an upper end of the body plate 41, and an upper end of the door liner 42. In addition, the lower cap deco 45 may be connected to a lower end of the side deco 44, a lower end of the body plate 41, and a lower end of the door liner 42.

That is, the outer appearance of the door body 40 may be defined by the body plate 41, the door liner 42, the side deco 44, the upper cap deco 43, and the lower cap deco 45. In addition, a space inside the door body 40, which is defined by coupling the body plate 41, the door liner 42, the side deco 44, the upper cap deco 43, and the lower cap deco 45, may be filled with an insulation material 400.

In addition, a structure for mounting the panel assembly 30 may be provided in the upper cap deco 43 and the lower cap deco 45.

In detail, an upper mounting part 431 into which an upper protrusion 343 protruding from the rear surface of the panel assembly 30 is inserted may be provided on the front surface of the upper cap deco 43. In addition, the upper protrusion 343 may be restricted by the upper cover 46 mounted on the opened top surface of the upper cap deco 43.

In addition, the lower cap deco 45 may include a lower cap deco bottom surface 451 defining the bottom surface of the door body 40, and a lower cap deco front surface 452 defining the front surface of the door body 40. The lower cap deco bottom surface 451 may protrude further forward than the lower cap deco front surface 452 and thus may support the lower end of the panel assembly 30.

In addition, a connector hole **452*a* through which a substrate connection part 363 of the lighting device 36 provided inside the panel assembly 30 passes may be defined in the lower cap deco front surface 452. In addition, a light connector 455 connected to the substrate connection part 363 may be disposed inside the connector hole 452*a*. Thus, when the panel assembly 30 is mounted, the lighting device 36 may be electrically connected to the light connector 455** to enable power supply and transmission of a control signal.

A lower coupling part 453 into which a bracket support part 356 and a cover support part 396, which protrude backward from a lower end of the rear surface of the panel assembly 30, are inserted may be disposed on the front surface of the lower cap deco 45. The bracket support part 356 and the cover support part 396 may be inserted into the lower coupling part 453.

The panel assembly 30 may be provided in a plate shape and may define the outer appearance of the front surface of the door 20 when mounted on the front surface of the door body 40. Since the panel assembly 30 defines the outer appearance of the front surface of the door 20, the panel assembly may be referred to as a door panel, and also, since the panel assembly 30 defines the outer appearance of the front surface of the refrigerator 1, the panel assembly 30 may be referred to as an exterior panel.

As described above, the panel assembly 30 may have a structure that is capable of being mounted separately from the door body 40 for service and maintenance.

The front surface of the panel assembly 30 may be exposed forward when mounted on the door body 40 and may define a substantial outer appearance of the front surface of the door 20. That is, the color of the front surface of the door 20 may be determined by the color of the front surface of the panel assembly 30. In addition, the entire front surface of the panel assembly 30 may be configured to shine in color designated by the user, and when the door 20 and the panel assembly 30 are mounted, the door 20 and the panel assembly 30 may be changed to various colors selected by the user so that the front surface of the door 20 have various colors.

Hereinafter, a structure of the panel assembly 30 will be described in detail with reference to the drawings.

FIG. 6 is an exploded perspective view when the panel assembly is viewed from a front side.

As illustrated in the drawing, the panel assembly 30 may include a panel 31 defining the outer appearance of the front surface, a lighting device 36 that irradiates light so that the panel 31 shines, a light guide plate 33 that guides the light irradiated from the lighting device 36, and a back cover 39 that defines an outer appearance of a rear surface of the panel assembly 30.

In addition, the panel assembly 30 may further include a fixing member 32 that mounting the light guide plate 33 and the panel 31.

In addition, the panel assembly 30 may further include an upper bracket 34 that defines a top surface of the panel assembly 30 and a lower bracket 35 that defines a bottom surface of the panel assembly 30. In addition, the lighting device 36 may be mounted on the lower bracket 35.

In more detail, the panel 31 may be formed in a rectangular plate shape and may be made of a transparent material capable of transmitting light. For example, the panel 31 may be made of a glass material such as blue glass, white glass, or evaporated glass, or other materials that allow light to pass, such as ABS, PMMA, or PC. Throughout the embodiments of the present invention, the "transparency" and "transmission" may be defined as a state in which the light passes therethrough to appear a set color through the panel 31.

In addition, the panel 31 may be provided to have a color. The panel 31 may be configured to transmit light emitted from the lighting device 36, but not illuminate components behind the panel 31.

The light guide plate 33 may be disposed at a rear side that is spaced apart from the panel 31 and configured to guide the light emitted from the lighting device 36 disposed behind the light guide plate 33 forward toward the panel 31. A reflective layer 331 may be disposed on the rear surface of the light guide plate 33 to direct the light inside the light guide plate 33 forward.

The fixing member 32 may be provided between the panel 31 and the light guide plate 33. The fixing member 32 may be configured so that the light guide plate 33 and the panel 31 are fixedly mounted. The fixing member 32 may be made of a material capable of transmitting light.

The fixing member 32 may include a plate-shaped front surface portion 321 and a side surface portion 322 protruding backward from each of both left and right ends of the front surface portion 321. The front surface portion 321 may be disposed between the panel 31 and the light guide plate 33. Here, a front surface of the front surface portion 321 may be in contact with the panel 31, and a rear surface of the front surface portion 321*n* may be in contact with the light guide plate 33. In addition, the side surface portion 322 may provide a structure in which the light guide plate 33 is fixed, and the upper bracket 34, the lower bracket 35, and the back cover 39 are mounted.

In detail, the front surface portion 321 may be provided in a plate shape having a size corresponding to the panel 31, and an adhesive may be applied around the front surface portion 321 so that the panel 31 adheres.

The side surface portion 322 may be disposed along both left and right ends of the light guide plate 33. In addition, the upper bracket 34, the lower bracket 35, and the back cover 39 may be mounted on the side surface portion 322.

In detail, the side surface portion 322 may have a groove, into which the light guide plate 33 is inserted, in an inner surface thereof, and the upper bracket 34 and the lower bracket 35 may be inserted into and fixed to opened upper and lower ends of the groove into which the light guide plate 33 is inserted, respectively.

In addition, upper and lower ends of the back cover 39 that defines the rear surface of the panel assembly 30 may be coupled to the upper bracket 34 and the lower bracket 35, and both ends of the back cover 39 may be coupled to the side surface portion 322. The remaining components of the panel assembly 30 except for the panel 31 may be fixed by the coupling of the back cover 39.

In detail, the back cover 39 may be provided in a plate shape made of a metal and may define the rear surface of the panel assembly 30. The back cover 39 may include a cover protrusion 391 at a center of the back cover 39 and a cover circumferential portion 392 disposed along a circumference of the cover protrusion 391, and the cover protrusion 391 and the cover circumferential portion 392 may be provided through forming.

The cover protrusion 391 may be provided inside the cover circumferential portion 392, that is, at the center of the back cover 39 and may protrude further forward than the cover circumferential portion 392. In addition, when the back cover 39 is installed, the rear surface of the light guide plate 33 may be supported by the cover protrusion 391. The cover protrusion 391 may support most of an area including the center of the light guide plate 33 from the rear side. Thus, the light guide plate 33 of which both the ends are supported may have a large plate-shaped structure, but may be supported more stably by the cover protrusion 391.

A plurality of cover screw holes 397 into which the cover coupling member 397*a* is coupled may be defined in upper and lower ends of the cover circumferential portion 392, respectively. The upper bracket 34 and the lower bracket 34 may be coupled to the upper and lower ends of the back cover 39 by coupling the cover coupling member 397*a*.

An overall restraint structure of the panel assembly 30 may be completed by coupling the cover coupling member 397*a*, and the upper bracket 34, the lower bracket 35, and the back cover 39 may be coupled to restrict even the fixing member 32 and the light guide plate 33.

In addition, a protrusion opening 395 through which the upper protrusion 343 protruding backward from the rear surface of the upper bracket 34 passes when the upper bracket 34 is mounted may be defined in an upper end of the circumferential portion 392.

In addition, a wire entrance 398 may be further provided at a lower end of the circumferential portion 392. The wire entrance 398 may be disposed at a position corresponding to the connector hole 452*a* and may be provided by cutting the lower end of the back cover 39.

A cover support part 396 may be disposed at the lower end of the cover circumferential portion 392, that is, the lower end of the back cover 39. The cover support part 396 may be bent backward and may be inserted into the lower coupling part 453 together with the bracket support part 356. In addition, the panel coupling member 457 inserted through a bottom surface opening 454 of the lower bracket 35 may pass through the bracket support 356 and the cover support 396 and then be coupled to a cap deco boss 456*a*. Thus, the lower end of the panel assembly 30 may be firmly fixed to the lower cap deco 45.

The structures of the upper bracket 34 and lower bracket 35 will be described in more detail below.

FIG. 7 is an exploded perspective view illustrating a coupled structure of the fixing member, which is one component of the panel assembly, the upper bracket, and the back cover.

As illustrated in the drawing, the upper bracket 34 may include an upper bracket extension portion 341 and an upper bracket top surface portion 342. The upper bracket extension portion 341 may be configured to mount the upper bracket 34 and may be disposed parallel to the panel 31 and the light guide plate 33 to extend in the vertical direction.

In addition, the upper bracket mounting part 344 coupled to the side surface portion 322 of the fixing member 32 may be disposed on each of both left and right ends of the upper bracket extension portion 341. When the upper bracket 34 is mounted on the fixing member 32, the upper bracket extension portion 341 may be exposed between the side parts 322 at both sides to support and couple the upper end of the back cover 39.

An upper protrusion 343 protruding backward may be disposed on the rear surface of the upper bracket extension portion 341. A plurality of the upper protrusions 343 may protrude along the upper bracket extension portion 341 and be coupled to the upper mounting part 431 of the upper cap deco 43. In addition, the upper protrusion 343 may protrude by passing through the protrusion opening 395 of the back cover 39 when the back cover 39 is mounted.

An upper bracket screw hole 345 may be defined in the upper bracket extension portion 341 for coupling the cover coupling member 397*a*. When the back cover 39 is mounted, the cover coupling member 397*a* may be coupled by sequentially passing through the cover screw hole 397 defined in the back cover 39 and the upper bracket screw hole 345.

The upper bracket top surface portion 342 may be disposed on the upper end of the upper bracket extension portion 341. A front end of the upper bracket top surface portion 342 may support the upper end of the panel 31 and may completely shield the fixing member 32 and the upper end of the light guide plate 33.

FIG. 8 is an exploded perspective view illustrating a coupled structure in which the fixing member, which is one component of the panel assembly, the lower bracket, and the back cover. In addition, FIG. 9 is an exploded perspective view illustrating a coupling structure of the lower bracket, the lighting device, and a light supporter.

As illustrated in the drawings, the lower bracket 35 may include a lower bracket front surface portion 351, a lower bracket rear surface portion 352, a lower bracket side surface portion 353, and a lower bracket bottom surface portion 354.

The lower bracket front surface portion 351 may define a shape of the front surface of the lower bracket 35, and an upper end of the lower bracket front surface portion 351 may support the lower end of the panel 31.

The lower bracket rear surface portion 352 may be disposed at a position spaced backward from the lower bracket front surface portion 351. The lower bracket rear surface portion 352 may define the rear surface of the lower bracket 35 and may protrude more upward than the lower bracket front surface portion 351 and the lower bracket side surface portion 353 to support the light guide plate 33 from the rear side and then be coupled to the back cover 39.

In addition, a lower bracket mounting part 352*b* that are stepped forward may be disposed on each of both left and right ends of the lower bracket rear surface portion 352. The lower bracket mounting part 352*b* may be inserted into and coupled to the lower end of the side surface portion 322 of the fixing member 32.

In addition, a lower bracket screw hole 352*c* into which a plurality of cover coupling members 397*a* are coupled may be defined in the lower bracket rear surface portion 352. When the back cover 39 is mounted, the cover coupling member 397*a* may be coupled to sequentially pass through the cover screw hole 397 and the lower bracket screw hole 352*c*.

A bracket opening 352*a* may be defined in the lower bracket rear surface portion 352. The lighting device 36 may enter through the bracket opening 352*a*. In addition, the bracket opening 352*a* may be shielded by the back cover 39.

The lower bracket bottom surface portion 354 may define a bottom surface of the lower bracket 35 and a bottom surface of a space in which the lighting device 36 is mounted. In addition, a bracket support part 356 protruding backward may be disposed on a rear end of the lower bracket bottom surface portion 354. The bracket support part 356 may protrude further backward than the lower bracket rear surface portion 352. In addition, the cover support part 396 protruding backward from the lower end of the back cover 39 may be seated on the bracket support part 356. Thus, when mounting the panel assembly 30, the cover support part 396 may be inserted into and coupled to the lower coupling part 453 disposed on the lower cap deco 45 while being seated on the bracket support part 356.

A plurality of light guide plate support parts 355 that support a lower end of the light guide plate 33 may be disposed on the lower bracket 35. The lower end of the light guide plate 33 may be supported by the light guide plate support part 355 to maintain a distance from the lighting device 36.

The lighting device 36 may be provided inside the lower bracket 35. The lighting device 36 may include a substrate 361 and a light source 362. The substrate 361 may be accommodated inside the lower bracket 35, and a plurality of light sources 362 may be continuously arranged at regular intervals on the substrate 361.

The light source 362 may be disposed to irradiate light toward the lower end of the light guide plate 33. The light source 362 may be provided as, for example, an LED. In addition, the light source 362 may be provided as RGB LEDS that emit light having various colors according to a control of a controller provided in the refrigerator 1. That is, the light source 362 may emit light having various colors according to the user's manipulation, and thus, the panel 31 may shine in color set by the user. In addition, a color of the outer appearance of the front surface of the refrigerator 1 may be determined depending on the color of the panel 31.

A substrate connection part 363 protruding backward may be disposed at one side of the substrate 361, and the substrate connection part 363 may protrude to be exposed through the wire entrance 398 provided on the back cover 39. Therefore, when the panel assembly 30 is mounted on the door body 40, the substrate connection part 363 may pass through the connector hole 452*a* defined in the door body 40 and be connected to the light connector 455. Of course, the substrate connection part 363 and the light connector 455 may be electrically connected to each other by being connected to separate wires and connectors disposed at the ends of the wires.

A light supporter 37 may be provided below the substrate 361. The light supporter 37 may include a horizontal portion 371 and a vertical portion 372. The horizontal portion 371 may define a bottom surface of the light supporter 37 and may be disposed below the substrate 361 to support the substrate 361. Here, a support groove 373 in which at least a portion of the substrate 361 is accommodated may be defined in a top surface of the horizontal portion 371.

A rear end of the horizontal portion 371 may extend to the bracket opening 352*a*, and the vertical portion 372 may extend upward from the rear end of the horizontal portion 371. The vertical portion 372 may support a rear end of the substrate 361 from the rear side. In addition, the vertical portion 372 may be exposed through the bracket opening 352*a* and may shield at least a portion of the bracket opening 352*a*.

When the back cover 39 is mounted on the lower bracket 35, the vertical portion 372 exposed through the bracket opening 352*a* may be in contact with the front surface of the back cover 39. Thus, heat of the substrate 361 may be transferred to the back cover 39 through the light supporter 37.

In detail, each of both the light supporter 37 and the back cover 39 that are in contact with the substrate 361 may be made of a metal material. Therefore, the heat generated from the substrate 361 may be transferred to the back cover 39 through the light supporter 37, and then, the heat may be dissipated from the entire rear surface of the panel assembly 30 through the back cover 39 to effectively dissipate the heat of the substrate 361.

In addition, when the panel assembly 30 is mounted, the back cover 39 may be in contact with the body plate 41 or the side deco 44, which is made of the metal, and thus may be in an electrically connected state.

In this state, the static electricity may be introduced into the door 20 due to the contact with the user's body during use. Here, if the static electricity introduced into the door 20 is introduced into the back cover 39 and the light supporter 37, the lighting device 36 may be damaged.

Thus, a grounding member 47 that guides the static electricity so that the static electricity introduced into the door 20 is not introduced into the panel assembly 30 may be provided on the door 20.

Hereinafter, the grounding member 47 will be described in more detail with reference to the drawings.

FIG. 10 is a perspective view of the grounding member according to an embodiment of the present invention. In addition, FIG. 11 is a partial perspective view illustrating a configuration of the door body on which the grounding member is mounted. In addition, FIG. 12 is a view illustrating an inflow and transfer path of the static electricity to the door.

As illustrated in the drawings, the door body 40 may be provided with the grounding member 47. The grounding member 47 may be configured to guide the static electricity generated in the door 20 toward the cabinet 10. In particular, the static electricity generated in the door 20 may be induced to flow toward the cabinet 10 through the door body 40, but do not flow toward the lighting device 36 of the panel assembly 30.

For this, the grounding member 47 may be directly or indirectly connected to the back cover 39 made of a metal material or be provided at one side that is electrically connected and also may be made of a material having resistance less than that of the back cover 39.

For example, the grounding member 47 may be connected to one side of the body plate 41 or the side deco 44 and may extend up to the outside of the door 20. In detail, the grounding member 47 may include a fixing part 473 that is connected to the body plate 41 or the side deco 44 and is made of a conductive material such as a metal material, a ground wire connected to one end of the fixing part 473 and guided to the outside of the door 20 through the hinge device 204, and a ground connector provided on an end of the ground wire 471.

The fixing part 473 may be made of a metal material having resistance less than that of the back cover 39 and may have a structure which is easily installed at one side of the door body 40. The fixing part 473 may be provided in a clip shape that is easily coupled to the end of the body plate 41 or the end of the side deco 44.

In detail, the fixing part 473 may be provided by bending a plate-shaped metal material to define an insertion part 473*a* that is recessed so that one end of the body plate or the side deco is inserted. The insertion part 473*a* may be provided so that metal plates are both sides are in contact with the ends of the body plate 41 or the side deco 44, and a pair of metal plates extend in the same direction while being spaced apart from each other.

For example, the fixing part 473 may be provided so that one end of the front deco 441 of the side deco 44 is inserted into the insertion part 473*a*. When assembling the door body 40, the fixing part 473 may be mounted so that one end of the deco front surface 441 is inserted into the insertion part 473*a* before the side deco 44 and the body plate 41 are coupled to each other by the coupling member 414.

In the state in which the fixing part 473 mounted on the front of the deco 441, when the side deco 44 and the body plate 41 are coupled to each other, the fixing part 473 may be covered by the body plate 41 and thus may not be exposed to the outside. In addition, one surface of the fixing part 473 may be in contact with the body plate 41, and when the body plate 41 and the side part 322 are in close contact with each other, one surface of the fixing part 473 may be firmly fixed between the body plate 41 and the side deco 44. Thus, even in the process of filling the inside of the door body 40 with the insulation material 400, the fixing part 473 may be prevented from moving out of its placement position or being separated from the side deco 44.

In addition, since the fixing part 473 is maintained in contact with the body plate 41, the fixing member 32 may regard as being mounted on the body plate 41. Of course, the fixing part 473 may be fixed so that the end of the body plate 41 is inserted into the insertion part 473*a*.

The fixing part 473 may be connected to an arbitrary position along the end of the deco front surface 441, but may be preferably connected to a position adjacent to the handle 456 which is manipulated by the user to open the door 20. That is, when the handle 456 is provided on the bottom surface of the door 20, the fixing part 473 may be connected to a lower portion of the front deco 441, which is adjacent to the handle 456.

A plurality of insertion part protrusions 473*b* may be disposed inside the insertion part 473*a*. Each of the insertion part protrusions 473*b* may have a sharp end that protrudes so that a surface of the body plate 41 or the side deco 44 is scratched in the process of inserting the end of the body plate 41 or the side deco 44 into the insertion part 473*a*. Thus, when insulating coating or painting is provided on the surface of the body plate 41 or the side deco 44, the insulating coating or painting may be removed so that the metal portion is in contact with the insertion part protrusion 473*b* to be electrically connected to each other. In addition, the insertion part protrusion 473*b* may be provided to have an inclination and thus facilitate the insertion of the body plate 41 or the side deco 44 and to be fixedly hooked in the inserted state.

A connection end 473*c* to which one end of the ground wire 471 is connected may be disposed on one end of the fixing part 473. The connection end 473*c* may extend from each of both sides and may be bent to surround the ground wire 471 and coupled to the ground wire 471.

The ground wire 471 may extend from the inside of the door body 40 to the cabinet 10 through the hinge device 204. Here, the wire 455*a* connected to the light connector 455 inside the door body 40 may also extend up to the cabinet 10 through the hinge device 204 together with the ground wire 471.

In addition, the ground connector 472 may be provided on an end of the ground wire 471, which extends to the outside of the door 20. The ground connector 472 may be disposed inside the hinge device 204 or at one side of the cabinet 10, which is adjacent to the hinge device 204 and may be connected to a cabinet connector 474 provided on the end of the cabinet ground wire 475 disposed on the cabinet 10. That is, in the process of mounting the door 20 on the cabinet 10, the ground connector 472 and the cabinet connector 474 may be connected to each other at the hinge device 204 or one side of the cabinet 10.

The wire 455*a* inside the door body 40 may be connected to the ground connector 472 together with the ground wire 471. In addition, a cabinet wire 455*b* may be connected to the cabinet connector 474. Thus, when the ground connector 472 and the cabinet connector 474 are connected to each other, the wire 455*a* and the cabinet wire 455*b* may also be connected to each other. Thus, the wire 455*a* inside the door 20 and the ground wire 471 may be connected to the cabinet wire 455*b* and the cabinet ground wire 475, respectively, only by connecting the ground connector 472 to the cabinet connector 474. Of course, the ground wire 471 and the wire 455*a* may be independently provided with separate connectors.

As illustrated in FIG. 12, in the state in which the panel assembly 30 is mounted on the door body 40, the substrate 361 may be in contact with the light supporter 37 made of the metal material to dissipate the heat of the lighting device 36, and the light supporter 37 may be in contact with the back cover 39 made of the metal material. In addition, the panel coupling member 457 exposed to the outside may be connected to one side of the back cover 39, that is, the cover support part 396.

In addition, in the state in which the panel assembly 30 is fixedly mounted on the door body 40, the back cover 39 may be in contact with the body plate 41 or the side deco 44 made of the metal material, and thus, the panel assembly 30 and the door body 40 may be electrically connected to each other.

The lighting device 36 may be provided inside the lower bracket 35 that defines the lower end of the panel assembly 30 and thus may disposed at a portion close to the handle 456 that is in contact with the user's hand to manipulate the opening and closing of the door 20.

In this state, the static electricity may be generated when the user inserts his/her hand into the door handle 456 to hold the door handle 456, thereby manipulating the door 20. In particular, the bottom surface of the door body 40, that is, the lower cap deco 45 may have a structure in which the handle 456 and the panel coupling member 457 are disposed adjacent to each other, and the static electricity generated while the user's hand is in contact with the handle 456 or the door 20 may be introduced into the door 20 along the panel coupling member 457.

Here, the static electricity introduced into the door 20 may not be introduced into the panel assembly 30, especially the lighting device 36, but be induced to be discharged to the outside by passing through the door 20 and the cabinet 10 through the grounding member 47 having relatively low resistance.

That is, the static electricity may move along the back cover 39 through the panel coupling member 457 disposed on the bottom surface of the door body 40 and may move upward along the front surface of the door body 40, i.e., the body plate 41 and the side deco 44.

Here, the resistance of the grounding member 47 connected to the side deco 44 may be provided to be less than the resistance of the back cover 39, and thus, the static electricity flowing along the back cover 39 may be induced toward the grounding member 47 via the body plate 41 or the side deco 44.

The static electricity introduced into the fixing part 473 may move along the ground wire 471 and may be induced from the hinge device 204 to the cabinet 10 through the cabinet ground wire 475. Thus, when the user touches and manipulate the door 20 or the panel assembly 204, the static electricity may be introduced into the lighting device 36 to prevent the lighting device 36 from being damaged.

Hereinafter, the overall arrangement of the ground wire in the refrigerator 1 will be described with reference to the drawings.

FIG. 13 is a schematic front view illustrating an arrangement of the ground wire in the refrigerator. In addition, FIG. 14 is a schematic side view illustrating the arrangement of the ground wire in the refrigerator.

As illustrated in the drawings, the cabinet 10 may be provided with a plurality of doors 20, and a panel assembly 30 provided with the lighting device 36 may be mounted on each of the plurality of doors 20. In addition, each of the plurality of doors 20 may be provided with the grounding member 47. Thus, a structure in which the static electricity is prevented even when any door of the plurality of doors 20 is manipulated by the user may be provided.

In detail, the lighting device 36 may be provided on the panel assembly 30 of the upper door, which is disposed at the upper side, of the doors, that is, the panel assembly 30 of the refrigerating compartment door 201. In addition, the grounding member 47 may be provided inside the door 201 to induce the static electricity generated in the door 201.

Here, the fixing part 473 of the grounding member 47 may be electrically connected to the back cover 39 made of the metal material or may be fixedly mounted on the body plate 41 or the side deco 44 that is directly or indirectly in contact with the back cover 39. In addition, the ground wire 471 may be guided to the outside of the door 201 through the upper hinge 204 disposed at the upper end of the door 201.

The ground connector 472 provided at the end of the ground wire 471 may be connected to the cabinet connector 474 connected to the cabinet ground wire 475 disposed at the upper portion of the cabinet 10. In addition, the ground connector 472 and the cabinet connector 474 may be connected to each other within the upper hinge 204 or the control box 13 disposed at the upper portion of the cabinet 10 and thus may not be exposed to the outside.

The ground wire 471 or the cabinet ground wire 475 may be connected to the power cord 141 within the control box 13. The power cord 141 may supply power to the refrigerator 1 and may include a power ground wire 471 connected to the ground wire 471 or the cabinet ground wire 475.

A plug 14 connected to a grounded wall outlet 15 may be connected to one end of the power cord 141, and a power connector 142 to be electrically connected to the ground wire 471 or the cabinet ground wire 475 may be provided on the other end of the power cord 141. The substrate may be provided inside the control box 13 to provide a structure in which the ground connector 472, the cabinet connector 474, and the power connector 142 are connected to each other.

The lighting device 36 may also be provided on the panel assembly 30 of the lower door disposed at a lower side, of the doors 20, that is, the freezing compartment door 202. In addition, the grounding member 47 may be provided inside the door 202 to induce the static electricity generated in the door 202.

The freezing compartment door 202 may have the same structure as the refrigerating compartment door 201 with a difference only in the arrangement position. Thus, the grounding member 47 may also have the same coupling structure with only a difference in the arrangement position. However, the grounding member 47 may be guided to the outside of the door 202 through the lower hinge 206, and the ground connector 472 and the cabinet connector 474 may be connected to each other on the lower hinge 206 or the bottom surface of the cabinet 10.

In addition, the cabinet 10 may be provided with the cabinet ground wire 475. The cabinet ground wire 475 may be configured to connect the ground wire 471 to the power cord 141 and may be disposed inside the cabinet 10. In addition, the cabinet ground wire 475 may be provided in plurality and may be provided with cabinet connectors 474 at both ends thereof and thus may be disposed to be connected to each other along the cabinet 10.

As described above, each of the plurality of doors 20 provided in the refrigerator 1 may be provided with the grounding member 47, and the plurality of grounding members 47 may provide a ground line connected to the power cord 141 through the door and the cabinet 10. That is, all the plurality of doors 20 may include the grounding member 47 that is directly or indirectly connected to the power cord 141 and may be included in the ground wire connected to the power cord 141.

Thus, even when the user manipulates any door 20, the static electricity generated between the door 20 and the door 20 may be discharged to the outlet 15 along the power cord 141 through the grounding member 47. Thus, all of the lighting devices 36 provided in the plurality of doors 20 may be protected from the static electricity.

Although not shown in detail, the wires 455 connected to electrical components such as the lighting device 36 inside the door 20 may be disposed together with the ground wire 471 and may share the ground connector 472 and the cabinet connector 474 and connected together with the ground connector 472 and the cabinet connector 474.

Hereinafter, operations of the refrigerator 1 and the panel assembly 30 having the above structure will be described in more detail with reference to the drawings.

FIG. 15 is a view illustrating an example of adjusting colors of home appliances to which the panel assembly using a remote device is applied. In addition, FIG. 16 is a cross-sectional view illustrating a light emitting state of the panel assembly. In addition, FIG. 17 is a front view illustrating the outer appearance of the front surface of the refrigerator in which the lighting device is turned on.

As illustrated in the drawings, the home appliance according to an embodiment of the present invention may have an appearance defined by the panel assembly 30, and a color of the outer appearance of the home appliance may be changed to a color set by the user according to an operation of the lighting device 36. The panel assembly may be displayed in various colors by light emitted from the rear side, and thus, the panel assembly 30 or the panel 31 may be referred to as a screen.

The home appliance may be any one of a refrigerator 1, an air conditioner 5, a dishwasher 6, a clothes care machine 7, a washing machine 8, or a cooking appliance 9, and a structure such as the panel assembly 30 may be applied to each of the home appliances to freely change the color of the outer appearance of the front surface.

For example, in the above-described embodiment and the refrigerator 1, the panel assembly 30 may be provided on the front surface of the door 20 that opens and closes the cabinet 10. In addition, the panel assembly 30 may shine in a set color according to the user setting, and a color of the outer appearance of the front surface of the refrigerator 1 may be changed.

For another example, an indoor unit of the air conditioner 5 may have a space in which a heat exchange device and a fan are provided inside a case 51 (or cabinet) that defines an outer appearance thereof. In addition, a front surface of the case 51 may be defined by the panel assembly 511. The panel assembly 511 may have the same structure as the panel assembly 30 of the above-described refrigerator 1 to emit light.

Thus, the panel assembly 511 may shines in a set color according to the user setting, and a color of an outer appearance of a front surface of the air conditioner 5 may be changed to the set color.

For another example, the dishwasher 6 may have a space in which dishes are washed inside a case 61 (or cabinet) that defines an outer appearance thereof. In addition, a front surface of the case 61 may be opened and closed by a door 62, and the front surface of the door 62 may be defined by a panel assembly 621. The panel assembly 621 may have the same structure as the panel assembly 30 of the above-described refrigerator 1 to emit light.

Thus, the panel assembly 621 may shines in a set color according to the user setting, and a color of an outer appearance of a front surface of the dishwasher 6 may be changed to the set color.

For another example, the clothes care machine 7 may have a space in which clothes are accommodated inside a case 71 (or cabinet) that defines an outer appearance thereof. In addition, a front surface of the case 71 may be opened and closed by a door 72, and the front surface of the door 72 may be defined by a panel assembly 721. The panel assembly 721 may have the same structure as the panel assembly 30 of the above-described refrigerator 1 to emit light.

Thus, the panel assembly 721 may shines in a set color according to the user setting, and a color of an outer appearance of a front surface of the clothes care machine 7 may be changed to the set color.

For another example, the washing machine 8 or dryer may have a space for washing or drying inside the case 81 (or cabinet) that defines an outer appearance thereof. In addition, the front surface of the case 81 may be opened and closed by the door 82. The front surface of the case 81 may be defined by a panel assembly 811. The panel assembly 811 may have the same structure as the panel assembly 30 of the above-described refrigerator 1 to emit light.

Thus, the panel assembly 30 may shines in a set color according to the user setting, and a color of an outer appearance of a front surface of the washing machine 8 or the dryer may be changed to the set color.

For another example, the cooking appliance 9 may have a space for cooking food inside the case 91 (or cabinet) that defines an outer appearance thereof. In addition, a front surface of the case 91 may be opened and closed by a door 92, and the front surface of the door 92 may be defined by a panel assembly 921. The panel assembly 921 may have the same structure as the panel assembly 30 of the above-described refrigerator 1 to emit light.

Thus, the panel assembly 921 may shine in a set color according to the user setting, and a color of an outer appearance of a front surface of the cooking appliance 9 may be changed to the set color.

Hereinafter, a process of changing a color of the panel assembly 30 will be described.

When the lighting device 36 is turned off, a color of an outer appearance of a front surface of the lighting device 36 may be expressed by the color of the panel 31. The color displayed on the panel 31 when the lighting device 36 is turned off may be referred to as a first color.

When the lighting device 36 operates, the color of the panel 31 may be changed according to a color of light emitted from the lighting device 36, and a color of the outer appearance of the front surface of the door 20 may be expressed in the selected color. Here, the color displayed through the panel by the light emitted from the lighting device 36 may be referred to as a second color.

The color of the panel 31 may be determined by the operation of the lighting device 36. For example, the lighting device 36 may be manipulated and set through a remote device 2 that is spaced apart from the refrigerator 1. The refrigerator 1 may communicate with the remote device 2 through a communication part 17 connected to the controller, and the user may manipulate the operation of the lighting device 36 through the remote device 2.

The communication part 17 may communicate with the remote device 2 in various manners. For example, the remote device 2 may be a variety of devices capable of communication such as a dedicated terminal, a mobile phone, a tablet, a portable PC, a desktop PC, a remote controller, or a Bluetooth speaker.

The user may manipulate and set the overall operation state of the lighting device 36, such as an operation time, operation conditions, and a color of the light source through the manipulation of the remote device 2. For example, simple operation and setting of the lighting device 36 may be performed through an application or dedicated program installed on the user's mobile phone. That is, the user may select a desired color of the panel 31 through the screen 2*a* of the remote device 2 such as a mobile phone or terminal.

In addition, the user may input a color through the control panel provided in the refrigerator 1 without using the remote device 2.

In addition, the refrigerator 1 and the remote device 2 may be connected to a server in a network state, and thus, the color of the panel 31 of the refrigerator 1 may be input through the server 3.

In the operation state of the lighting device 36, as illustrated in FIG. 16, when the lighting device 36 is turned on, the light emitted from the LED 362 may be irradiated to the lower end of the light guide plate 33.

The light incident through the lower end of the light guide plate 33 may be diffused and reflected along the light guide plate 33 to move along the light guide plate 33. Here, the light guided by the light guide plate 33 may be reflected forward by the reflective layer 331 and transmitted to the outside through the panel 31.

The light directed forward through the light guide plate 33 may pass through the fixing member 32 to illuminate the panel 31, and the front surface of the door 20 may shine with a set brightness or color.

When the lighting device 36 is turned off, as illustrated in FIG. 1, the front surface of the door 20 may not shine, and an original color of the panel assembly 30, that is, the first color, may appear. In this state, the lighting device 36 may be turned on, and when the lighting device 36 is turned on, the front surface of the door 20 may shine in the second color selected by the user.

For example, as illustrated in FIG. 16, the controller may control the front surface of the door 20 to shine in the second color different from the first color, and the lighting device 36 may be controlled by the controller so that the LED 362 shines in a set color. Here, the color of the panel 31 may be selected by the user and also may be selected by manipulating the remote device 2 or the manipulation part 14.

When the controller instructs to change the color of the light emitted from the lighting device 36 while the color of the outer appearance of the front surface of the refrigerator 1 shines in the set color, the panel 31 may shine in a color that is reset by the controller.

In addition, the panel 31 constituting some of the plurality of doors 20 defining the outer appearance of the front surface of the refrigerator 1 may emit light, or the panel 31 constituting the plurality of doors 20 may independently emit light having colors different from each other to define the outer appearance of the front surface of the refrigerator 1.

In addition to the foregoing embodiments of the present invention, various embodiments may be exemplified. Another embodiment of the present invention is characterized in that the grounding member has a structure in which the grounding member is coupled to the coupling member. Another embodiment of the present invention has the same structure as the above-described embodiment except for the structure of the grounding member, and thus, the same reference numerals will be used for the same components, and detailed description thereof will be omitted.

Hereinafter, another embodiment of the present invention will be described with reference to the drawings.

FIG. 18 is a partial perspective view illustrating a configuration of a door body to which a grounding member is mounted according to another embodiment of the present invention.

As illustrated in the drawing, a door 20 according to another embodiment of the present invention may include a panel assembly 30 in a door body 40. In addition, the door body 40 may include a body plate 41, a side deco 44, and a lower cap deco 45.

The body plate 41 and the side deco 44, which are made of a metal material, may be coupled to each other by a coupling member 414 such as a rivet or screw. In addition, the coupling member 414 may be connected to a grounding member 47'.

The grounding member 47' may include a fixing part 476 coupled to the coupling member 414, a ground wire 471 connected to the fixing part 476, and a ground connector 472 connected to the other end of the ground wire 471. The fixing part 476 may be provided in a plate shape through which the coupling member 414 passes and may be fixed between the body plate 41 and a deco front surface 441 of the side deco 44.

The fixing part 476 may be provided in a ring shape having a hole passing through a center thereof and may have a structure that is connected and fixed to the fixing part 476 using the coupling member 414, which couples the body plate 41 to the side deco 44, without a separate structure that fixes the fixing member 476.

The fixing part 476 may be made of a material having electrical resistance less than that of a back cover 39, and thus, static electricity generated in a door 20 or a panel assembly 30 may be induced to flow along the grounding member 47' through the fixing part 476.

In addition, the ground wire 471 may be guided downward of the door 20 through a hinge mounting part 459 disposed on the lower cap deco 45. In addition, the ground connector 472 disposed at an end of the ground wire 471 may be connected to a cabinet connector 474 of the cabinet ground wire 475 at the lower hinge 206 or a bottom surface of the cabinet connector 474.

A light connector 455 connected to the lighting device 36 and a wire 455*a* connected to the light connector 455 may be provided inside the door 20, and the wire 455*a* may be guided to the outside of the door 20 together with the ground wire 471 and be connected to the ground connector 472. In addition, it may have a structure connected to the cabinet wire 455*b* and the cabinet connector 474 disposed at a side of the cabinet 10.

The present invention may have other embodiments in addition to the above-described embodiments. Further another embodiment of the present invention is characterized in that the grounding member has a structure coupled to the panel assembly. Further another embodiment of the present invention has the same structure the above-described embodiment except for the coupling structure of the grounding member, and thus, the same reference numerals will be used for the same components, and detailed description thereof will be omitted.

Hereinafter, further another embodiment of the present invention will be discussed with reference to the drawings.

FIG. 19 is an exploded perspective view of a panel assembly according to further another embodiment of the present invention. In addition, FIG. 20 is a cutaway perspective view illustrating a state in which the grounding member is mounted on the panel assembly.

As illustrated in the drawings, a door 20 according to further another embodiment of the present invention may include a panel assembly 30 in a door body 40. In addition, the panel assembly 30 may include a panel 31, a light guide plate 33, a lower bracket 35, a lighting device 36, a light supporter 37, and a back cover 39.

The lighting device 36 may be provided inside the lower bracket 35 so that a light source 362 irradiates light to a lower end of the light guide plate 33. In addition, the light supporter 37 made of a metal material may support a substrate 361 inside the lower bracket 35.

In addition, the back cover 39 made of a metal material may be coupled to the lower bracket 35 and be in contact with a rear surface of the light supporter 37 so that heat of the substrate 361 is dissipated to the back cover 39 through the light supporter 37. Here, the back cover 39 may be in contact with a front surface of the door body 40 made of a metal material, that is, a body plate 41. Thus, the back cover 39 and the door body 40 may be electrically connected to each other.

The back cover 39 may be coupled to the lower bracket 35 by coupling a cover coupling member 397*a*, and the panel assembly 30 may be assembled by coupling the back cover 39 to the lower bracket 35.

Here, a grounding member 47" may be connected to the cover coupling member 397*a*. The grounding member 47" may include a fixing part 477 through which the cover coupling member 397*a* passes, a ground wire 471 connected to the fixing part 477, and a ground connector 472 connected to the other end of the ground wire 471. The fixing part 477 may be provided in a plate shape, and a through-hole 477*a* through which the cover coupling member 397*a* may pass may be defined. That is, the fixing part 477 may be provided in a ring shape and may be closely fixed to the back cover 39.

Thus, the grounding member 47" may be mounted in a process of coupling the cover coupling member 397*a* to couple the back cover 39 to the lower bracket 35. That is, the cover coupling member 397*a* may be coupled in a state in which the fixing part 477 is aligned with a screw hole 397 of the back cover 39 without a separate structure for fixing the fixing part 477 to fix the grounding member 47".

The fixing part 477 may be made of a material having electrical resistance less than that of a back cover 39, and thus, static electricity generated in a door 20 or a panel assembly 30 may be induced to flow along the grounding member 47" through the fixing part 477.

In addition, the ground wire 471 may extend to the outside of the door, and the ground connector 472 disposed at an end of the ground wire 471 may be connected to hinge devices 204 or 206 or a cabinet connector 474 of a cabinet ground wire 475 disposed at one side of the cabinet 10.

Industrial Applicability

The home appliances according to the embodiments of the present invention may have the improved outer appearance use convenience and thus have high industrial and applicability.

The invention claimed is:

1. A home appliance comprising:
a cabinet having a storage space; and
a door comprised by a door body that opens or closes the cabinet and a panel assembly detachably mounted on the door body,
wherein the panel assembly comprises:
a panel defining a front surface of the door; and
a lighting device provided behind the panel,
wherein the door body is provided with a grounding member configured to induce static electricity generated in the panel assembly to the door body.

2. The home appliance according to claim 1, wherein the door body comprises:
a body plate facing the panel assembly; and
a side deco defining a side surface of the door body,
wherein at least one of the body plate or the side deco is made of a metal material, and the grounding member is connected to the body plate or the side deco.

3. The home appliance according to claim 2, wherein the grounding member comprises a fixing part which is made of a conductive material and into which an end of the body plate or the side deco is inserted.

4. The home appliance according to claim 2, wherein the grounding member comprises a fixing part made of a conductive material and inserted between the body plate and the side deco, which are in contact with each other.

5. The home appliance according to claim 2, wherein the grounding member comprises a fixing part which is made of a conductive material and through which a coupling member configured to connect the body plate to the side deco passes.

6. The home appliance according to claim 2, wherein the panel assembly comprises a back cover defining a rear surface of the panel assembly and made of a metal material, and
at least one of the body plate or the side deco is in contact with the back cover.

7. The home appliance according to claim 1, wherein the panel assembly comprises a back cover defining a rear surface of the panel assembly and made of a metal material, and
the grounding member comprises a fixing part made of a conductive material and connected to the back cover.

8. The home appliance according to claim 7, wherein a cover coupling member is coupled to the back cover, and
the fixing part is penetrated by the cover coupling member.

9. The home appliance according to claim 1, wherein the grounding member comprises:
a ground wire extending along the inside of the door body;
a fixing part provided on one end of the ground wire and made of a conductive material to be electrically connected to the panel assembly; and
a ground connector provided at the other end of the ground wire and connected to a cabinet ground wire disposed on the cabinet.

10. The home appliance according to claim 1, wherein the grounding member comprises:

a ground wire guided toward the cabinet by passing through a hinge device configured to connect the door to the cabinet inside the door body; and a ground connector provided on an end of the ground wire, wherein the ground connector is connected to a cabinet connector of a cabinet ground wire provided on the cabinet.

11. The home appliance according to claim 10, further comprising a power cord connected to an inlet of a wall to supply power, wherein the power cord comprises:

a power ground wire for grounding; and a power connector provided on one end of the power ground wire and connected to the ground connector or the cabinet connector.

12. The home appliance according to claim 11, wherein the door is provided in plurality, and the ground connector of the ground wire, the cabinet connector, and the power connector, which extend from the plurality of doors, are connected to a control box provided on the cabinet.

13. The home appliance according to claim 1, wherein the door body is provided with a lighting connector connected to a substrate connection part provided in the lighting device, and a wire connected to the lighting connector is guided to the outside of the door together with a ground wire of the grounding member.

14. The home appliance according to claim 13, wherein ends of the wire and the ground wire are connected to one ground connector, ends of a cabinet wire and a cabinet ground wire, which are provided on the cabinet, are connected to one cabinet connector, and the wire, the cabinet wire, the ground wire, and the cabinet ground wire are connected to each other by connecting the ground connector to the cabinet connector.

15. The home appliance according to claim 1, wherein a handle configured to open and close the door is provided on the door body, and the grounding member is provided at a side adjacent to the handle with respect to a center of the door.

16. A home appliance comprising:

a cabinet having a storage space; and a door comprised a door body that opens or closes the cabinet and a panel assembly detachably mounted on the door body, wherein the panel assembly comprises:

a panel defining a front surface of the door;

a lighting device provided behind the panel;

a back cover defining a rear surface of the panel assembly and made of a metal material; and a grounding member extending from a side thereof, which is electrically connected to the back cover, to the door body to induce static electricity generated in the door.

17. The home appliance according to claim 16, wherein a cover coupling member configured to couple the back cover is coupled to the back cover, and wherein the grounding member is fixed to the back cover by the cover coupling member.

18. The home appliance according to claim 17, wherein the grounding member comprises:

a fixing part having a through-hole through which the cover coupling member passes and made of a metal material having electrical resistance less than that of the back cover;

a ground wire extending one end of the fixing part to pass through the inside of the door body; and a ground connector provided on the other end of the ground wire and connected to a cabinet ground wire disposed on the cabinet.

19. The home appliance according to claim 16, wherein a light supporter configured to support a substrate of the lighting device and made of a metal material is provided below the lighting device, and wherein when the back cover is coupled, the light supporter is in contact with the back cover to dissipate heat of the lighting device through the back cover.

20. The home appliance according to claim 16, wherein a front surface of the door body is defined by a body plate made of a metal material, and wherein when the panel assembly is mounted, the back cover is in contact with the body plate.

* * * * *